US012643698B2

(12) United States Patent
Ishiguro et al.

(10) Patent No.: US 12,643,698 B2
(45) Date of Patent: Jun. 2, 2026

(54) BINDING MACHINE

(71) Applicant: Max Co., Ltd., Tokyo (JP)

(72) Inventors: Hiroki Ishiguro, Tokyo (JP); Taichi Yamazaki, Tokyo (JP); Shigeki Shindou, Tokyo (JP)

(73) Assignee: Max Co., Ltd., Tokyo (JP)

( * ) Notice: Subject to any disclaimer, the term of this patent is extended or adjusted under 35 U.S.C. 154(b) by 209 days.

(21) Appl. No.: 18/494,424

(22) Filed: Oct. 25, 2023

(65) Prior Publication Data

US 2024/0140636 A1 May 2, 2024

(30) Foreign Application Priority Data

Oct. 26, 2022 (JP) ..... 2022-171064

(51) Int. Cl.

| | |
|---|---|
| ***B65B 13/02*** | (2006.01) |
| ***B65B 13/18*** | (2006.01) |
| ***B65B 13/28*** | (2006.01) |
| ***E04G 21/12*** | (2006.01) |

(52) U.S. Cl.

CPC ..... *B65B 13/02* (2013.01); *B65B 13/185* (2013.01); *B65B 13/28* (2013.01); *E04G 21/123* (2013.01)

(58) Field of Classification Search

CPC ..... B21F 15/00; B21F 15/02; B21F 15/04; B21F 7/00; B65B 13/22; B65B 13/28; B65B 13/285; B65B 13/025; B65B 13/04; B65B 13/06; B65B 27/10; B25B 25/00; E04G 21/123; E04G 21/122

See application file for complete search history.

(56) References Cited

U.S. PATENT DOCUMENTS

| | | | | |
|---|---|---|---|---|
| 2007/0199610 | A1 | 8/2007 | Itagaki | |
| 2018/0148943 | A1 | 5/2018 | Itagaki et al. | |
| 2018/0207709 | A1* | 7/2018 | Kasahara | B65B 13/025 |
| 2019/0214239 | A1 | 7/2019 | Sugiyama et al. | |
| 2020/0254508 | A1 | 8/2020 | Yoshida et al. | |
| 2020/0290109 | A1* | 9/2020 | Yoshida | B21F 15/06 |

(Continued)

FOREIGN PATENT DOCUMENTS

| | | | |
|---|---|---|---|
| EP | 3321450 | A1 | 5/2018 |
| JP | 2006-027685 | A | 2/2006 |

(Continued)

OTHER PUBLICATIONS

Feb. 24, 2024—(EP) Extended Search Report—App 23204862.9.

*Primary Examiner* — Bobby Yeonjin Kim
(74) *Attorney, Agent, or Firm* — Banner & Witcoff, Ltd.

(57) ABSTRACT

A binding machine includes: an accommodating portion configured to accommodate a wire; a wire feeding portion configured to feed the wire accommodated in the accommodating portion; a curl forming portion configured to constitute an annular feeding path for winding the wire fed by the wire feeding portion around an object to be bound; and a binding portion configured to twist the wire wound around the object to be bound. The curl forming portion includes a curl guide configured to curl the wire fed by the wire feeding portion, and a leading guide configured to lead the wire curled by the curl guide to the binding portion. The accommodating portion is disposed to be offset in one direction with respect to the curl guide. The curl guide is configured to feed out the wire toward the one direction.

6 Claims, 29 Drawing Sheets

(56) References Cited

U.S. PATENT DOCUMENTS

| | | | | |
|---|---|---|---|---|
| 2020/0290110 | A1* | 9/2020 | Yoshida | B21F 15/04 |
| 2020/0290760 | A1 | 9/2020 | Yoshida et al. | |
| 2020/0378140 | A1 | 12/2020 | Itagaki et al. | |
| 2021/0387246 | A1 | 12/2021 | Kasahara et al. | |
| 2022/0220755 | A1 | 7/2022 | Itagaki et al. | |
| 2022/0333392 | A1 | 10/2022 | Yoshida et al. | |

FOREIGN PATENT DOCUMENTS

| | | | |
|---|---|---|---|
| JP | 2020-133129 | A | 8/2020 |
| JP | 2020-147297 | A | 9/2020 |
| JP | 6791141 | B2 | 11/2020 |
| JP | 6971141 | B2 | 11/2021 |
| WO | 2017014276 | A1 | 1/2017 |

* cited by examiner

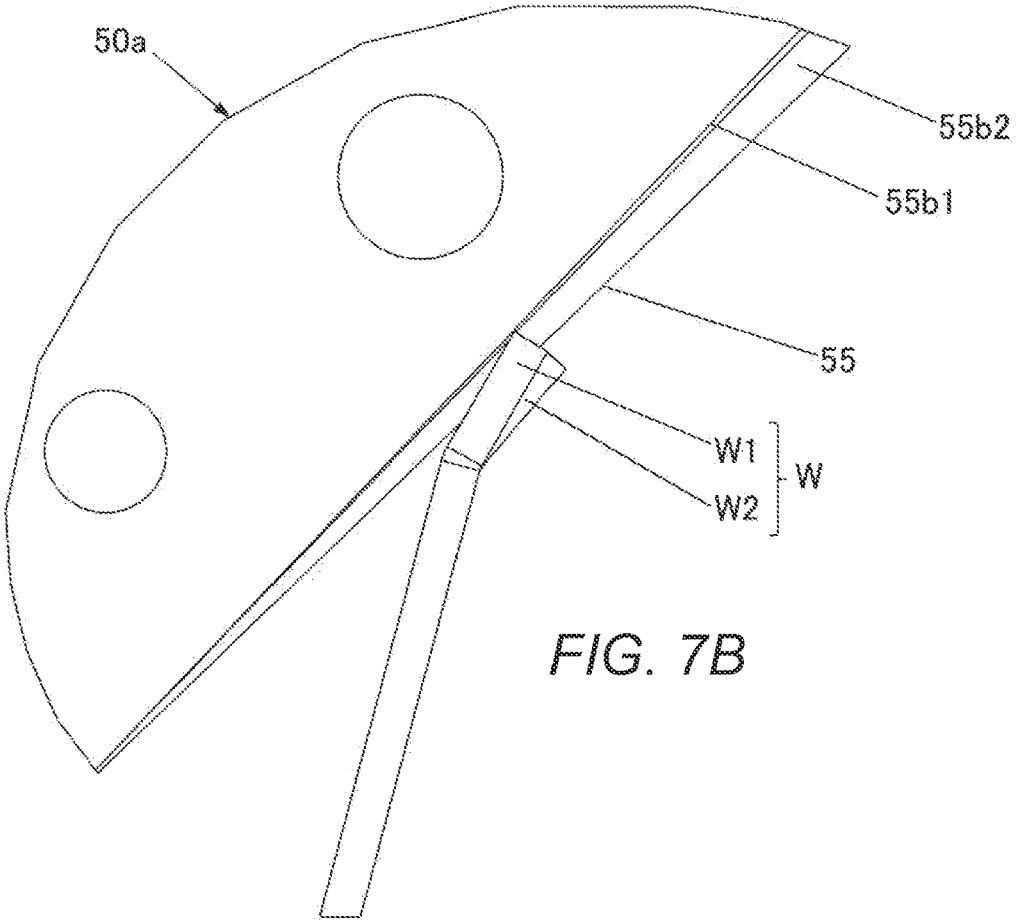
FIG. 7B
FIG. 7C
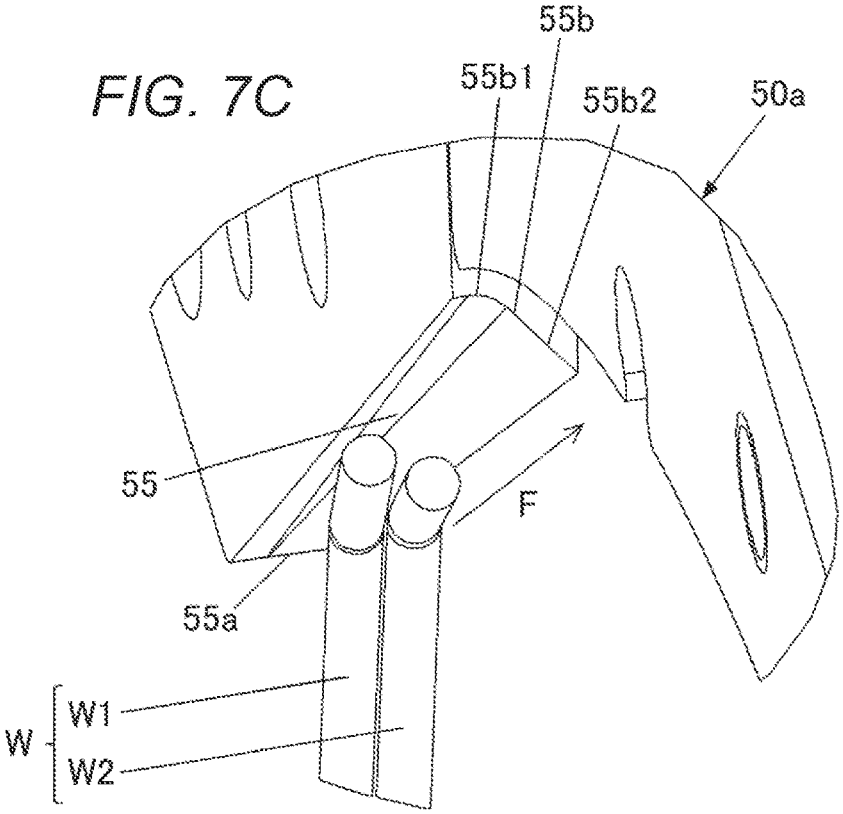

BINDING MACHINE

CROSS-REFERENCE TO RELATED APPLICATIONS

This application is based on Japanese Patent Application No. 2022-171064 filed on Oct. 26, 2022, the contents of which are incorporated herein by way of reference.

TECHNICAL FIELD

The present disclosure relates to a binding machine that binds an object to be bound such as reinforcing bars with a wire.

BACKGROUND ART

Reinforcing bars are used for a concrete structure in order to improve strength, and the reinforcing bars are bound by a wire such that the reinforcing bars do not deviate from a predetermined position during concrete placement.

Therefore, a binding machine referred to as a reinforcing bar binding machine is proposed. The binding machine includes a feeding unit capable of feeding a wire and winding the wire around reinforcing bars and a binding unit for binding the reinforcing bars by gripping and twisting the wire wound around an object to be bound by the feeding unit, thereby winding the wire around two or more reinforcing bars and twisting the wire wound around the reinforcing bars to bind the two or more reinforcing bars with the wire (for example, see Patent Literature 1).

Patent Literature 1: JP6791141B

When a diameter of the reinforcing bars to be bound increases, it is necessary to increase a diameter of a feeding path of the wire annularly wound around the reinforcing bars. However, when the diameter of the annular feeding path of the wire increases, a position of the wire, which is fed from a curl guide by the feeding of the wire by a wire feeding portion, along an axial direction of the annular feeding path varies in the feeding path of the wire.

This variation increases as the diameter of the annular feeding path increases. In addition, since an accommodating portion of the wire is disposed to be offset in one direction with respect to the curl guide, the wire which is fed from the accommodating portion and is curled by the curl guide is directed in the other direction which is the opposite direction to the one direction in which the accommodating portion is offset. Therefore, the wire may not enter a leading guide. On the other hand, if the size of the leading guide is increased so that the wire can enter into the leading guide, a size and a weight of the binding machine are increased, which may deteriorate operability.

The present disclosure is made to solve such a problem, and an example of the object of the present disclosure is to provide a binding machine in which the position of the wire, which is fed from the curl guide by feeding the wire by the wire feeding portion, along the axial direction of the annular feeding path is stabilized in the feeding path of the wire.

SUMMARY OF INVENTION

In order to solve the above problem, the present disclosure relates to a binding machine including: an accommodating portion configured to accommodate a wire; a wire feeding portion configured to feed the wire accommodated in the accommodating portion; a curl forming portion configured to constitute an annular feeding path for winding the wire fed by the wire feeding portion around an object to be bound; and a binding portion configured to twist the wire wound around the object to be bound, in which the curl forming portion includes a curl guide configured to curl the wire fed by the wire feeding portion, and a leading guide configured to lead the wire curled by the curl guide to the binding portion, the accommodating portion is disposed to be offset in one direction with respect to the curl guide, and the curl guide is configured to feed out the wire toward the one direction.

BRIEF DESCRIPTION OF DRAWINGS

FIG. 7B is an enlarged side view of a main portion illustrating the example of the operation of leading the wire in the parallel direction in the curl guide.

FIG. 7C is an enlarged perspective view of the main portion illustrating the example of the operation of leading the wire in the parallel direction in the curl guide.

DESCRIPTION OF EMBODIMENTS

Hereinafter, embodiments of a reinforcing bar binding machine as an embodiment of a binding machine of the present disclosure will be described with reference to the drawings.

Figure 1A:
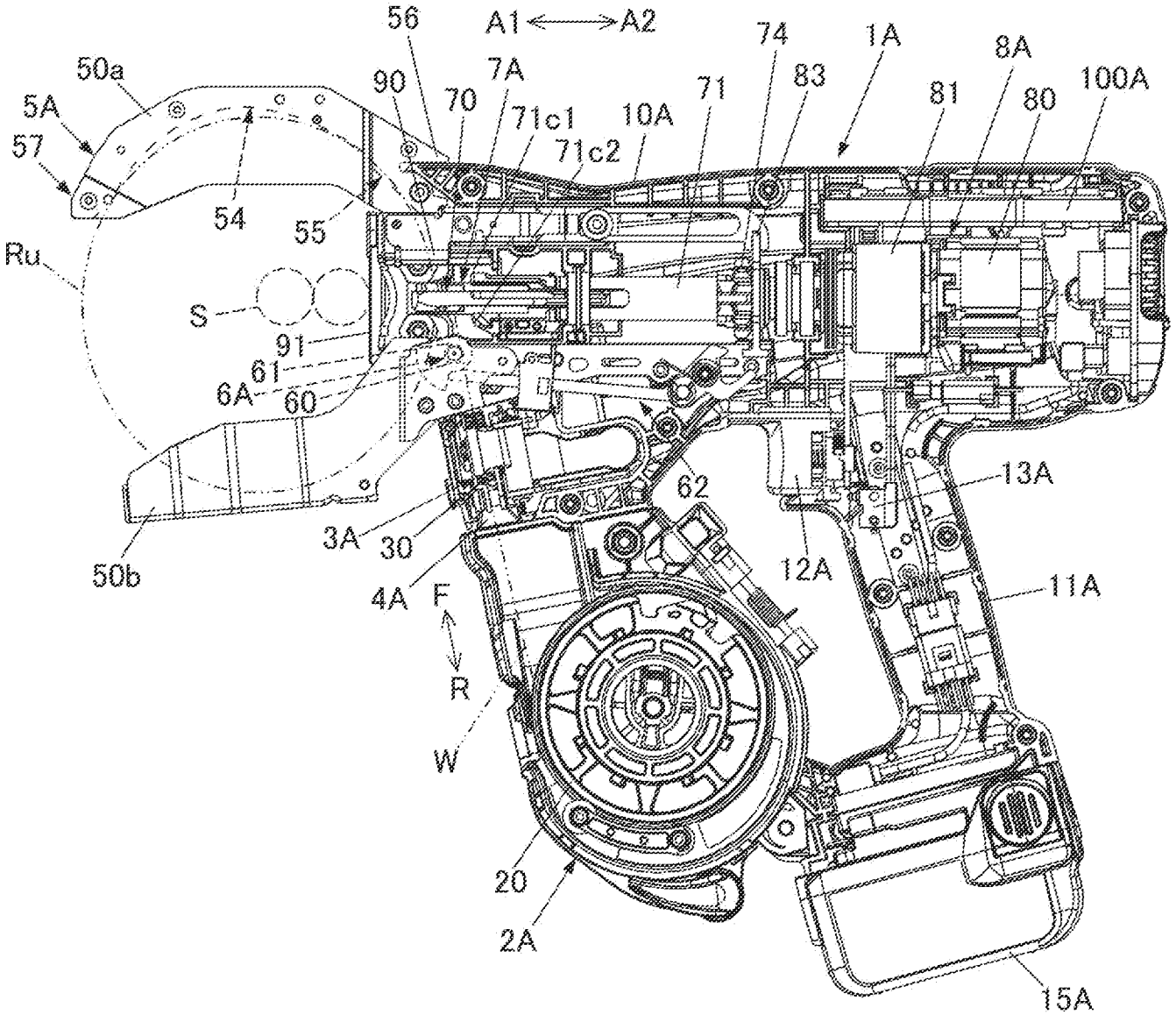
FIG. 1A is an internal configuration diagram illustrating an example of an overall configuration of a reinforcing bar binding machine according to a first embodiment when viewed from a side.
Figure 1B:
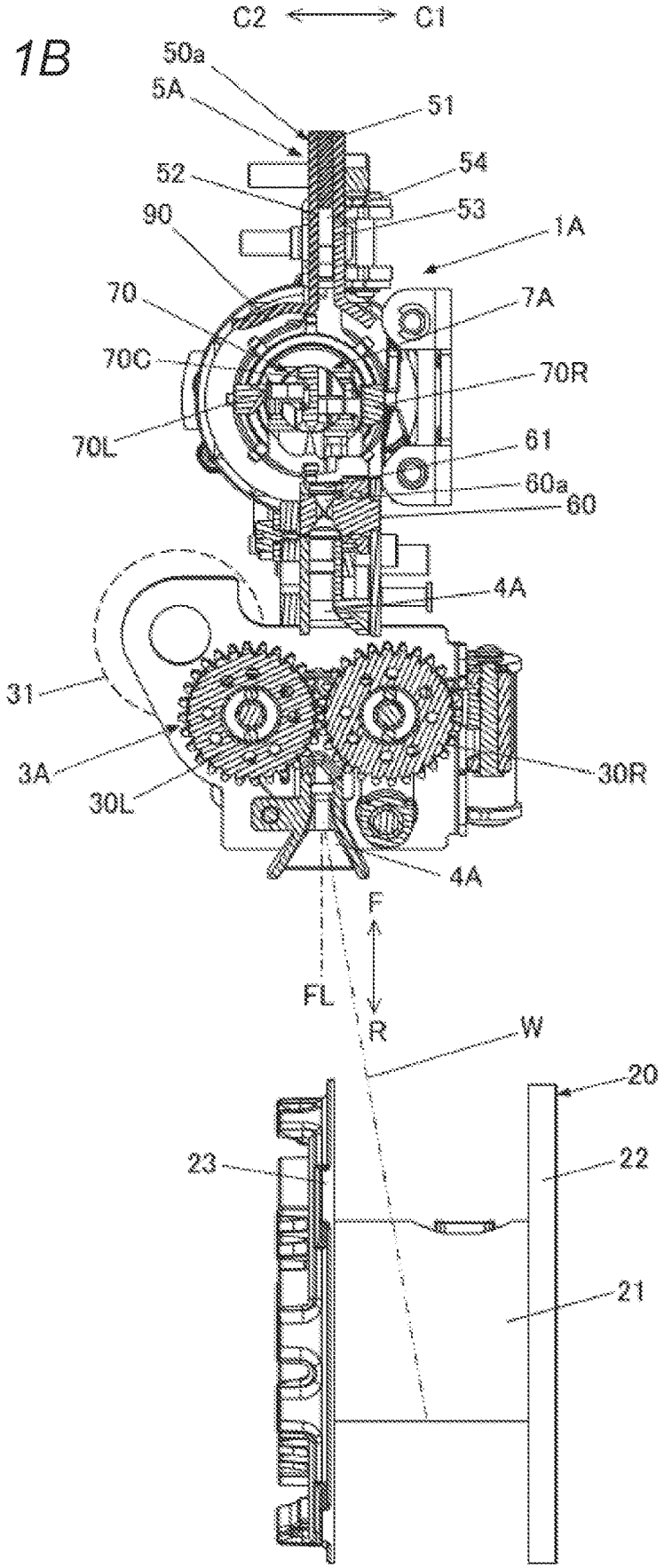
FIG. 1B is an internal configuration diagram illustrating the example of the overall configuration of the reinforcing bar binding machine according to the first embodiment when viewed from a front.
Figure 1C:
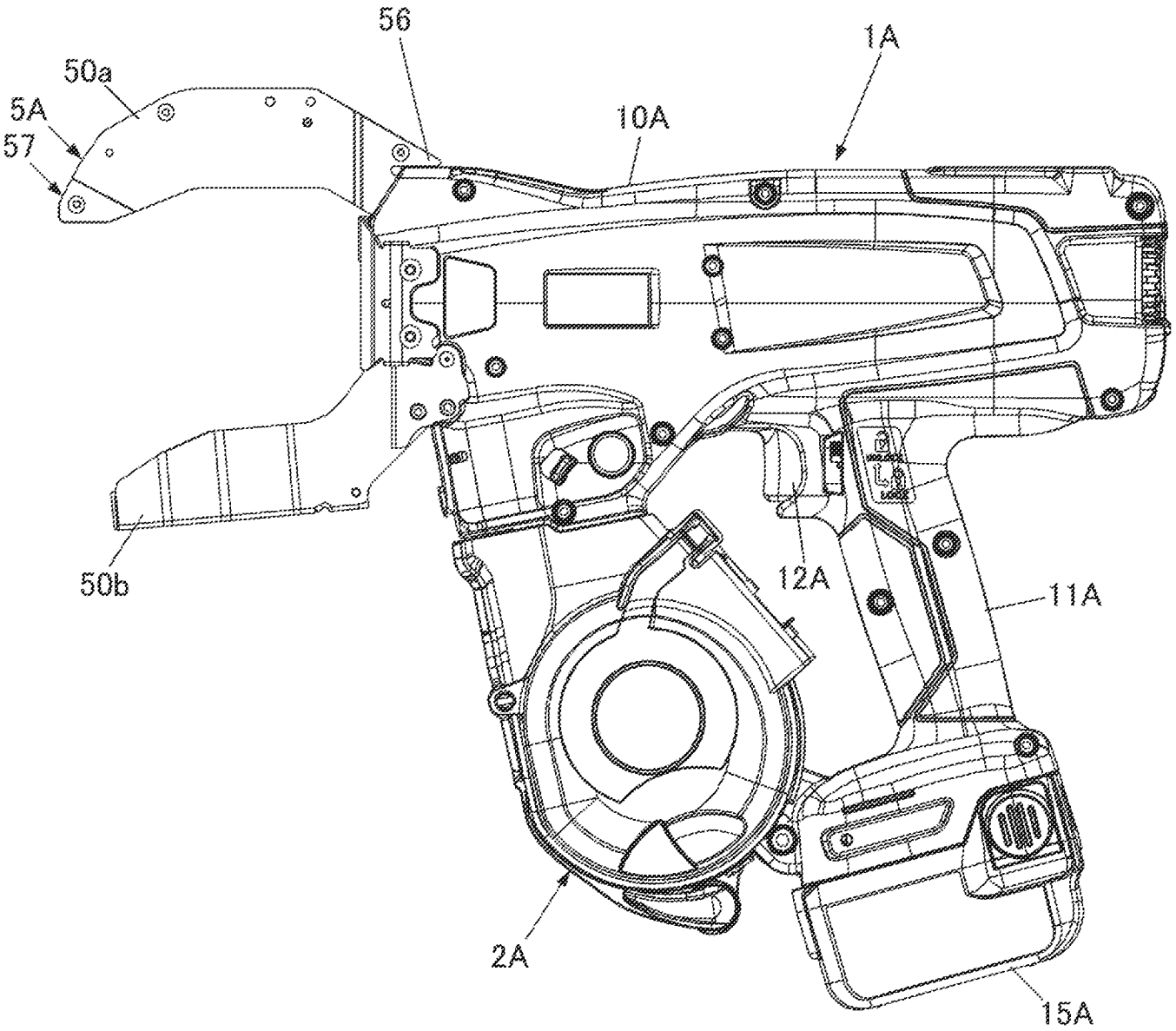
FIG. 1C is a side view illustrating the example of the overall configuration of the reinforcing bar binding machine according to the first embodiment.
Figure 1D:
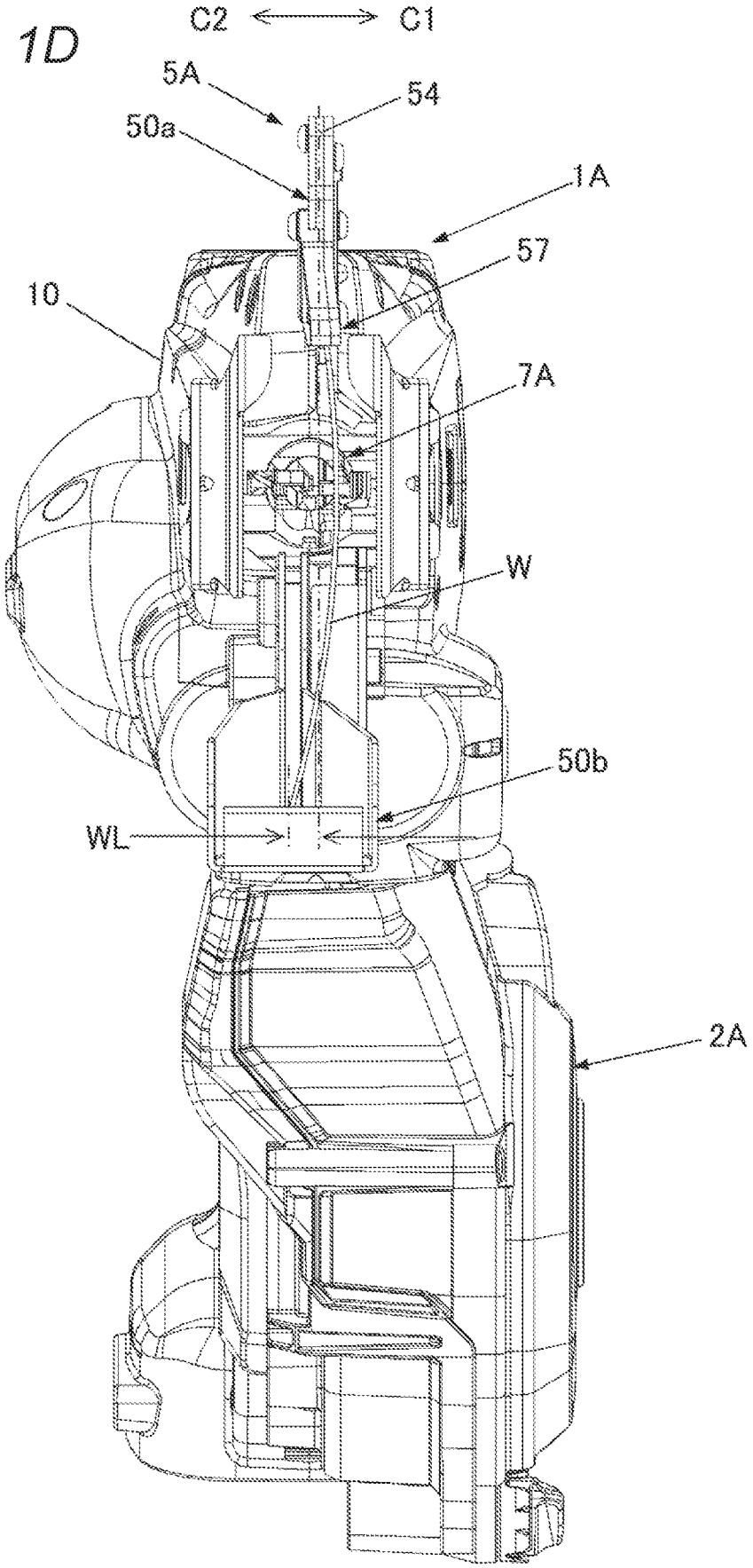
FIG. 1D is a front view illustrating the example of the overall configuration of the reinforcing bar binding machine according to the first embodiment.

Configuration Example of Reinforcing Bar Binding Machine According to First Embodiment FIG. 1A is an internal configuration diagram illustrating an example of an overall configuration of a reinforcing bar binding machine according to a first embodiment when viewed from a side, FIG. 1B is an internal configuration diagram illustrating the example of the overall configuration of the reinforcing bar binding machine according to the first embodiment when viewed from a front, FIG. 1C is a side view illustrating the example of the overall configuration of the reinforcing bar binding machine according to the first embodiment, and FIG. 1D is a front view illustrating the example of the overall configuration of the reinforcing bar binding machine according to the first embodiment.

A reinforcing bar binding machine 1A is used by being held by a hand of an operator and includes a main body portion 10A and a handle portion 11A. The reinforcing bar binding machine 1A feeds a wire W in a forward direction indicated by an arrow F, winds the wire W around reinforcing bars S serving as objects to be bound, feeds the wire W wound around the reinforcing bars S in a reverse direction indicated by an arrow R, winds the wire W around the reinforcing bars S, and then twists the wire W to bind the reinforcing bars S with the wire W. The reinforcing bar binding machine 1A binds the reinforcing bars S with a plurality of wires W, in this example, two wires W.

In order to implement the above functions, the reinforcing bar binding machine 1A includes a magazine 2A in which the wire W is accommodated, a wire feeding portion 3A that feeds the two wires W side by side in a radial direction of the wire W, and a wire guide 4A that guides the two wires W fed to the wire feeding portion 3A. The reinforcing bar binding machine 1A further includes a curl forming portion 5A that constitutes an annular feeding path for winding the two wires W fed by the wire feeding portion 3A around the reinforcing bars S, and a cutting portion 6A that cuts the two wires W wound with the reinforcing bars S. Further, the reinforcing bar binding machine 1A includes a binding portion 7A that twists the two wires W wound with the reinforcing bars S and a driving portion 8A that drives the binding portion 7A.

The magazine 2A is an example of an accommodating portion, and rotatably and detachably accommodates a reel 20, around which the long wire W is wound in a manner of being capable of being drawn out. As the wire W, a wire formed of a metal wire capable of being plastically deformed, a wire obtained by coating a metal wire with a resin, or a stranded wire may be used.

The reel 20 includes a tubular hub portion 21 around which the wire W is wound, and a pair of flange portions 22 and 23 integrally provided at both axial direction end sides of the hub portion 21. The flange portions 22 and 23 have a substantially circular plate shape having a larger diameter than the hub portion 21 and are provided concentrically with the hub portion 21. In the reel 20, the two wires W are wound around the hub portion 21 and can be simultaneously pulled out from the reel 20.

As illustrated in FIG. 1D, in the reinforcing bar binding machine 1A, the magazine 2A is disposed so as to be offset in a first direction indicated by an arrow C1 which is one direction with respect to a curl guide 50*a* of the curl forming portion 5A, which will be described later. Accordingly, as illustrated in FIG. 1B, the reel 20 is attached to the reinforcing bar binding machine 1A in a state in which the reel 20 is offset in the first direction indicated by the arrow C1 along an axial direction of the reel 20 along the axial direction of the hub portion 21 with respect to a feeding path FL of the wire W defined by the wire feeding portion 3A, the wire guide 4A, and the like.

The wire feeding portion 3A includes a pair of feeding gears 30 (30L and 30R) that sandwich and feed two parallel wires W. In the wire feeding portion 3A, a rotating operation of a feeding motor 31 is transmitted to one feeding gear 30L. Further, the rotating operation of one feeding gear 30L is transmitted to the other feeding gear 30R by engagement of gear portions provided on outer peripheries of the feeding gear 30L and the feeding gear 30R. Thus, one feeding gear 30L serves as a driving side and the other feeding gear 30R serves as a driven side.

The wire feeding portion 3A causes the two wires W to be arranged in parallel along a direction in which the pair of feeding gears 30L and 30R are arranged. In the wire feeding portion 3A, one wire W is in contact with a groove portion of one feeding gear 30L, the other wire W is in contact with a groove portion of the other feeding gear 30R, and one wire W and the other wire W are in contact with each other. Thus, the wire feeding portion 3A feeds the two wires W sandwiched between the pair of feeding gears 30 (30L and 30R) along an extension direction of the wire W by a frictional force generated between the one feeding gear 30L and the one wire W, a frictional force generated between the other feeding gear 30R and the other wire W, and a frictional force generated between the two wires W, by rotating the pair of feeding gears 30 (30L and 30R).

In the wire feeding portion 3A, a rotation direction of the feeding gear 30 is switched by switching forward and reverse of a rotation direction of the feeding motor 31, and forward and reverse of a feeding direction of the wire W is switched.

The wire guides 4A are arranged on an upstream side and a downstream side of the feeding gears 30 with respect to the feeding direction of the wire W fed in the forward direction. The wire guide 4A guides the two wires W, which are inserted into the wire guide 4A, between the pair of feeding gears 30 in such a manner that the two wires W are arranged in parallel along the direction in which the pair of feeding gears 30 are arranged.

In the wire guide 4A, an opening area of an opening on the upstream side with respect to the feeding direction of the wire W fed in the forward direction is larger than that of an opening on the downstream side, and a part or all of an inner surface of the opening is tapered. Accordingly, an operation of inserting the wire W drawn out from the reel 20 accommodated in the magazine 2A into the wire guide 4A can be easily performed.

The curl forming portion 5A includes the curl guide 50*a* which curls the two wires W fed by the wire feeding portion 3A and regulates a direction in which the two wires W are arranged in parallel, and a leading guide 50*b* that leads the two wires W, which are curled by the curl guide 50*a*, to the binding portion 7A. The curl forming portion 5A forms an annular feeding path Ru as indicated by a two-dot chain line in FIG. 1A from the curl guide 50*a* to the binding portion 7A through the leading guide 50*b* by curling the two wires W which are fed by the wire feeding portion 3A and pass through the curl guide 50*a*. The curl guide 50*a* allows the two wires W to pass in a state of being arranged in the radial direction of the annular feeding path Ru. Further, the curl guide 50*a* leads the two wires W so as to be arranged in a radial direction of the annular feeding path Ru. As shown in FIG. 1D, in the front view of the reinforcing bar binding machine 1A, the curl guide 50*a* is located above the leading guide 50*b* and within a width of the leading guide 50*b*. As shown in FIG. 1D, in the front view of the reinforcing bar binding machine 1A, a center of the leading guide 50*b* is offset in a second direction indicated by an arrow C2 with respect to the curl guide 50*a*.

The cutting portion 6A includes a fixed blade portion 60, a movable blade portion 61 that cuts the wire W in cooperation with the fixed blade portion 60, and a transmission mechanism 62 that transmits an operation of the binding portion 7A to the movable blade portion 61. The cutting portion 6A cuts the wire W by a rotating operation of the movable blade portion 61 with the fixed blade portion 60 as a fulcrum shaft. Further, the cutting portion 6A leads the two wires W so as to be arranged in a radial direction of the annular feeding path Ru by the operation of cutting the two wires W.

The binding portion 7A includes a wire locking body 70 in which the wire W is locked, and a sleeve 71 that actuates the wire locking body 70. The driving portion 8A includes a motor 80 and a speed reducer 81 that performs deceleration and torque amplification.

The reinforcing bar binding machine 1A includes a feeding regulation portion 90 against which a distal end of the wire W abuts, at a terminal end of the feeding path of the wire W which passes through the annular feeding path Ru and which is locked by the wire locking body 70. In the reinforcing bar binding machine 1A, the curl guide 50*a* and the leading guide 50*b* of the curl forming portion 5A described above are provided at a front side end portion of the main body portion 10A. Further, in the reinforcing bar binding machine 1A, an abutting portion 91 against which the reinforcing bar S abuts is provided between the curl guide 50*a* and the leading guide 50*b* at the front side end portion of the main body portion 10A. Furthermore, the reinforcing bar binding machine 1A includes a convex portion 56 that receives a force applied to the curl guide 50*a* in the main body portion 10A, in the curl guide 50*a*. The convex portion 56 is provided on a main body portion 10A side of the curl guide 50*a*, protrudes in a direction of the main body portion 10A, and can come into contact with the main body portion 10A.

In the reinforcing bar binding machine 1A, the handle portion 11A extends downward from the main body portion 10A. Further, a battery 15A is detachably attached to a lower portion of the handle portion 11A. In the reinforcing bar binding machine 1A, the magazine 2A is provided in the front of the handle portion 11A. In the reinforcing bar binding machine 1A, the wire feeding portion 3A, the cutting portion 6A, the binding portion 7A, the driving portion 8A that drives the binding portion 7A, and the like as described above are accommodated in the main body portion 10A.

In the reinforcing bar binding machine 1A, a trigger 12A is provided on a front side of the handle portion 11A, and a switch 13A is provided inside the handle portion 11A. In the reinforcing bar binding machine 1A, a controller 100A controls the feeding motor 31 and the motor 80 in accordance with a state of the switch 13A pressed by an operation of the trigger 12A.

Main Portion Configuration Example of Reinforcing Bar Binding Machine According to the Present Embodiment

Configuration Example of Curl Guide

Figure 2A:
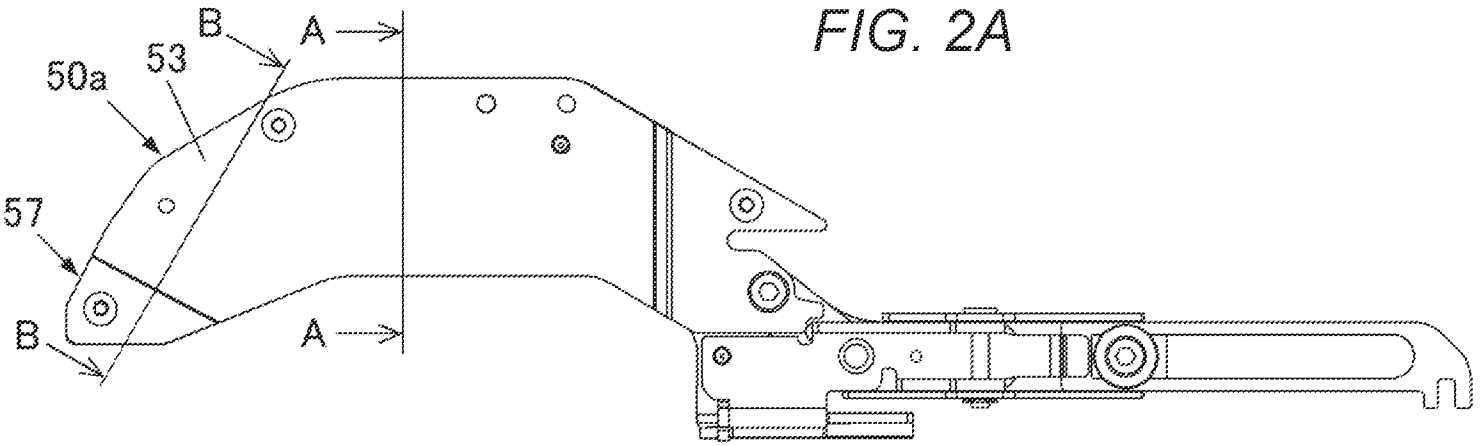
FIG. 2A is a side view illustrating an example of a curl guide.
Figure 2B:
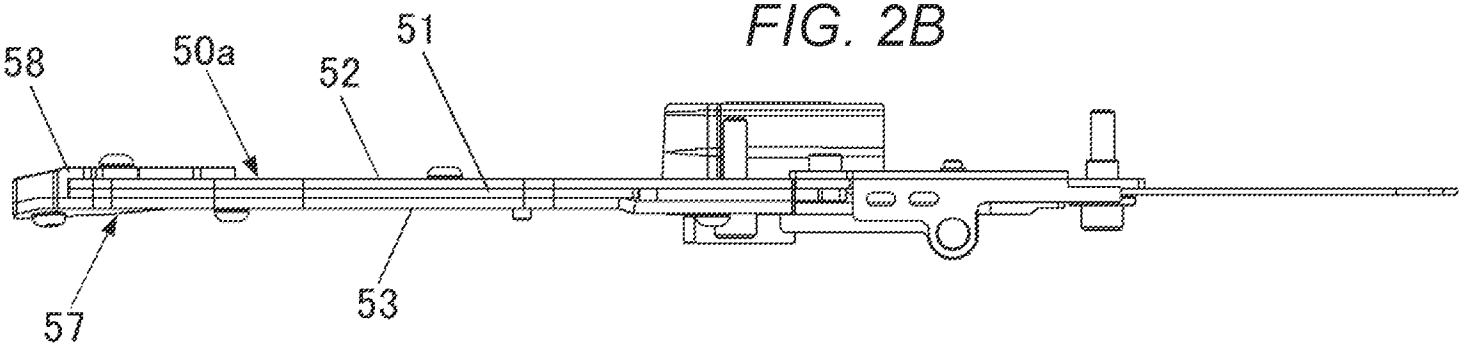
FIG. 2B is a top view illustrating the example of the curl guide.
Figure 2C:
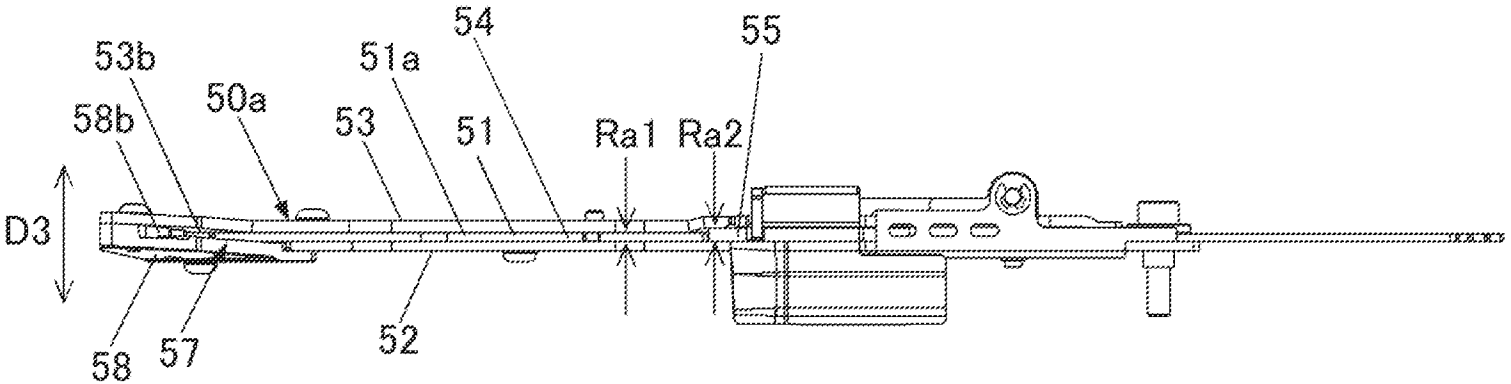
FIG. 2C is a bottom view illustrating the example of the curl guide.
Figure 2D:
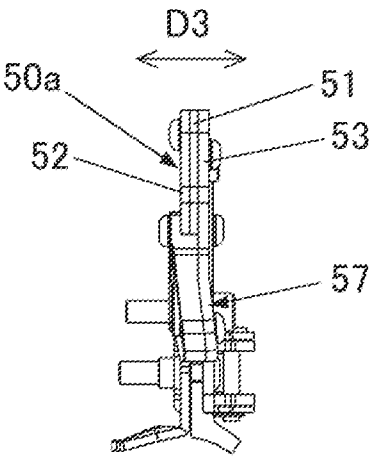
FIG. 2D is a front view illustrating the example of the curl guide.
Figure 2E:
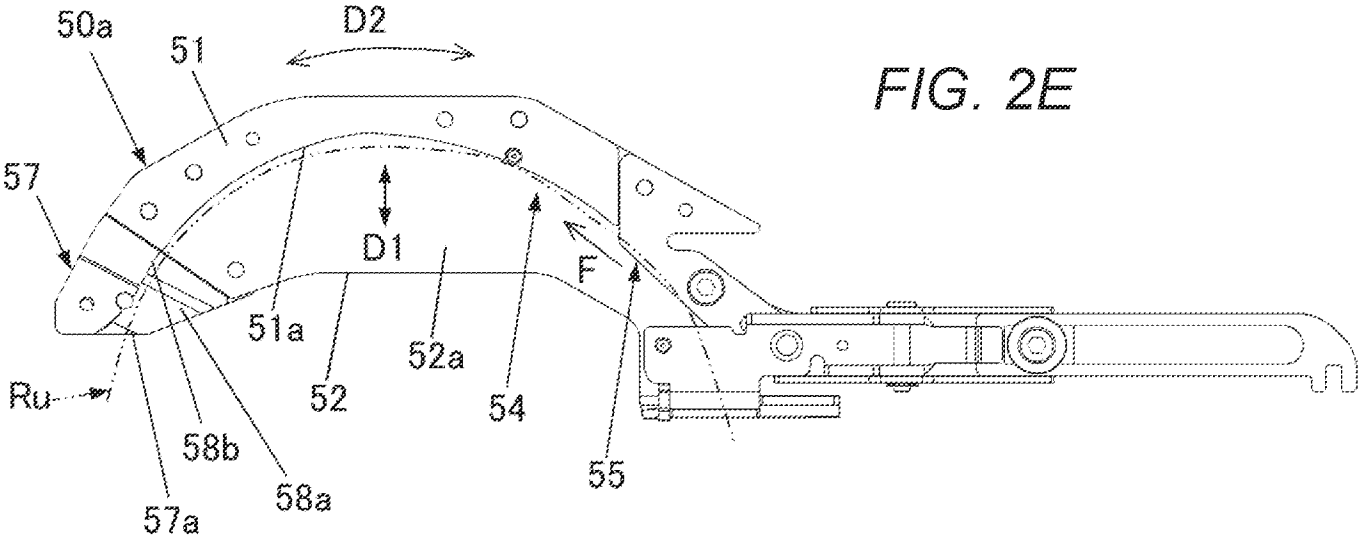
FIG. 2E is a side view illustrating an example of a state in which some components of the curl guide are removed.
Figure 2G:
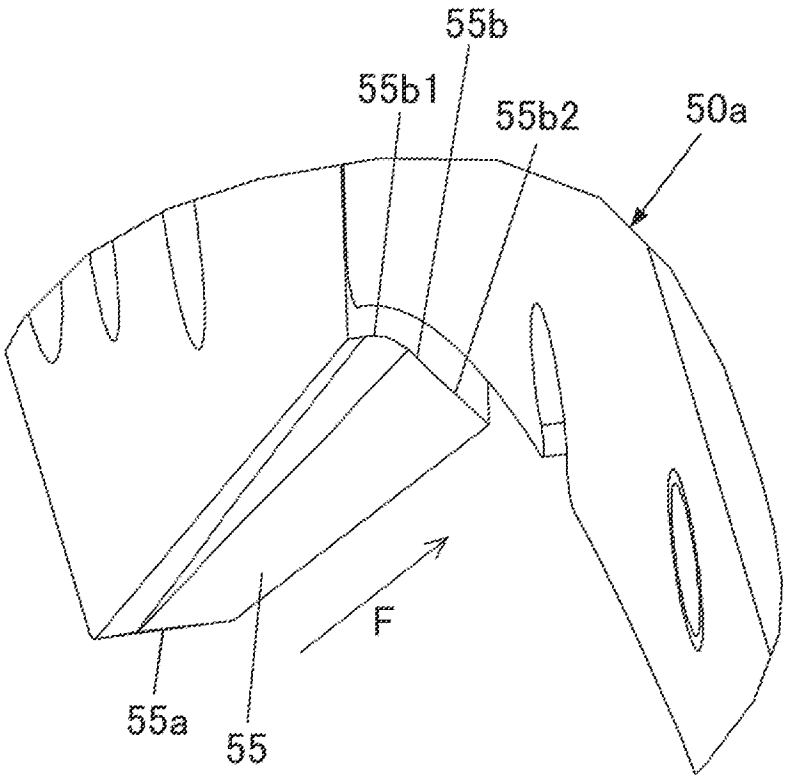
FIG. 2G is a main portion perspective view illustrating an example of a parallel direction leading portion of the curl guide.
Figure 2F:
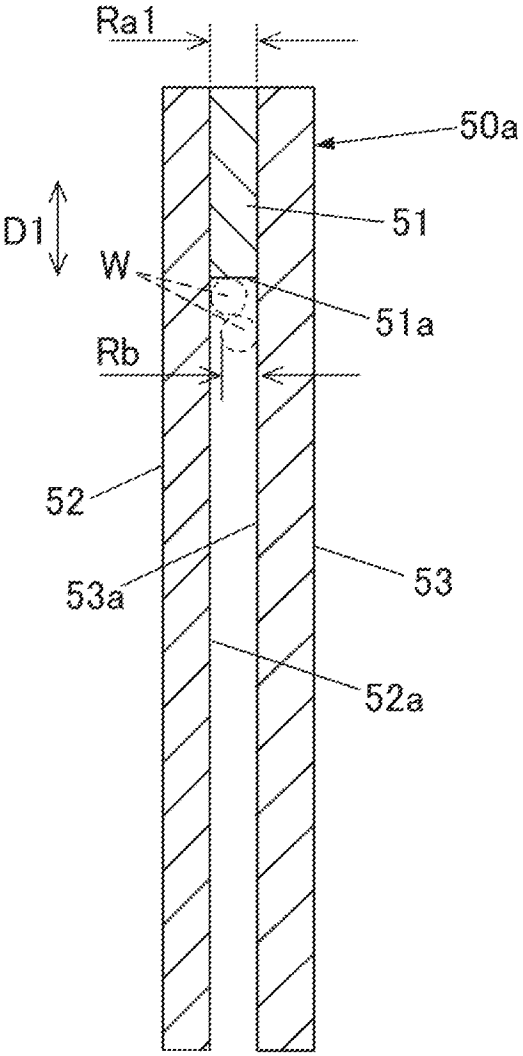
FIG. 2F is a front cross-sectional view illustrating the example of the curl guide.
Figure 2H:
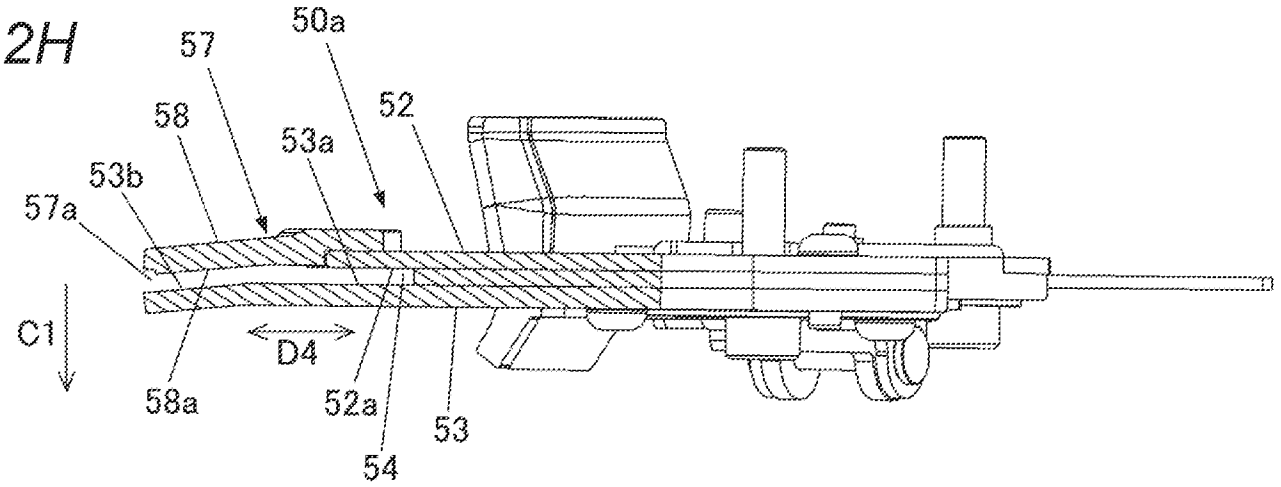
FIG. 2H is a cross-sectional view illustrating an example of a feeding direction leading portion of the curl guide.

FIG. 2A is a side view illustrating an example of a curl guide, FIG. 2B is a top view illustrating the example of the curl guide, FIG. 2C is a bottom view illustrating the example of the curl guide, and FIG. 2D is a front view illustrating the example of the curl guide. FIG. 2E is a side view illustrating an example of a state in which some components of the curl guide are removed. FIG. 2F is a front cross-sectional view illustrating the example of the curl guide, and FIG. 2G is a main portion perspective view illustrating an example of a parallel direction leading portion of the curl guide. FIG. 2H is a cross-sectional view illustrating an example of a feeding direction leading portion of the curl guide. FIG. 2F is a cross-sectional view taken along line A-A of FIG. 2A. FIG. 2H is a cross-sectional view taken along line B-B of FIG. 2A. Next, an example of the curl guide 50*a* will be described with reference to the drawings.

The curl guide 50*a* includes a first wire guide 51 that regulates the position of the wire W toward the outer peripheral side in the radial direction along the peripheral direction of the annular feeding path Ru indicated by an arrow D2 in the radial direction of the annular feeding path Ru indicated by an arrow D1 in FIGS. 2E and 2F.

The curl guide 50*a* further includes a second wire guide 52 that regulates the position of the wire W toward one side in the axial direction along the peripheral direction of the annular feeding path Ru indicated by the arrow D2 in the axial direction of the annular feeding path Ru indicated by an arrow D3 in FIGS. 2C, 2D, 2F, and the like.

Furthermore, the curl guide 50*a* includes a third wire guide 53 that regulates the position of the wire W toward the other side in the axial direction along the peripheral direction of the annular feeding path Ru indicated by the arrow D2 in the axial direction of the annular feeding path Ru indicated by the arrow D3.

The first wire guide 51 includes a first guide surface 51*a* formed of a concave curved surface or the like along the annular feeding path Ru.

The second wire guide 52 has a shape including a portion in contact with one side surface of the first wire guide 51 along the axial direction of the annular feeding path Ru and a portion protruding inward in the radial direction of the annular feeding path Ru from the first guide surface 51*a* of the first wire guide 51. The second wire guide 52 includes a second guide surface 52*a* at a portion protruding inward in the radial direction of the annular feeding path Ru from the first guide surface 51*a* of the first wire guide 51.

The third wire guide 53 has a shape including a portion in contact with the other side surface of the first wire guide 51 along the axial direction of the annular feeding path Ru and a portion protruding inward in the radial direction of the annular feeding path Ru from the first guide surface 51*a* of the first wire guide 51. The third wire guide 53 includes a third guide surface 53*a* at a portion protruding inward in the radial direction of the annular feeding path Ru from the first guide surface 51*a* of the first wire guide 51.

In the curl guide 50*a*, the first wire guide 51 is sandwiched between the second wire guide 52 and the third wire guide 53, and the second guide surface 52*a* of the second wire guide 52 and the third guide surface 53*a* of the third wire guide 53 face each other with an interval corresponding to a thickness of the first wire guide 51.

The curl guide 50*a* includes a parallel guide portion 54 that allows the two wires W to pass in a state of being arranged in the radial direction of the annular feeding path Ru indicated by the arrow D1. Further, the curl guide 50*a* includes a parallel direction leading portion 55 that leads the two wires W passing through the parallel guide portion 54 so as to be arranged in the radial direction of the annular feeding path Ru.

The parallel direction leading portion 55 leads the two wires passing through the curl guide 50*a* to be arranged in the radial direction of the annular feeding path Ru on the downstream side of the magazine 2A in the feeding direction of the wire W fed in the forward direction indicated by the arrow F. In the curl guide 50*a*, the parallel direction leading portion 55 is provided on the upstream side in the feeding direction of the wire W fed in the forward direction indicated by the arrow F, and the parallel guide portion 54 is provided on the downstream side in the feeding direction of the wire W fed in the forward direction indicated by the arrow F. The parallel direction leading portion 55 is provided on the downstream side of the wire feeding portion 3A, preferably on the downstream side of the wire locking body 70 in the feeding direction of the wire W fed in the forward direction indicated by the arrow F.

The parallel guide portion 54 is formed of a groove portion in which the second guide surface 52*a* of the second wire guide 52 and the third guide surface 53*a* of the third wire guide 53 face each other on both sides along the axial direction of the annular feeding path Ru and an outer peripheral side along the radial direction of the annular feeding path Ru is closed by the first guide surface 51*a* of the first wire guide 51 between the second guide surface 52*a* and the third guide surface 53*a*.

In the curl guide 50*a*, an interval (width) Ra1 between the second guide surface 52*a* of the second wire guide 52 and the third guide surface 53*a* of the third wire guide 53 is set to be greater than a diameter Rb of the wire W and smaller than twice the diameter Rb of the wire W at a portion where the parallel guide portion 54 is provided. Thus, the curl guide 50*a* cause the two wires W fed by the wire feeding portion 3A to pass in a state of being arranged in the radial direction of the annular feeding path Ru with the regulation by the interval Ra1 between the second guide surface 52*a* and the third guide surface 53*a* of the parallel guide portion 54. The interval Ra1 of the parallel guide portion 54 is preferably 1.5 times or less the diameter Rb of the wire W so that a direction in which the two wires W are parallel to each other is 45 degrees or less in the radial direction of the annular feeding path Ru.

The parallel direction leading portion 55 is formed of a surface on the outer peripheral side along the radial direction of the annular feeding path Ru. In the curl guide 50*a*, an interval Ra2 between the second guide surface 52*a* of the second wire guide 52 and the third guide surface 53*a* of the third wire guide 53 is set to be greater than twice the diameter Rb of the wire W at a portion where the parallel direction leading portion 55 is provided. Accordingly, in the curl guide 50*a*, the two wires W passing through the parallel direction leading portion 55 can be arranged in parallel in a direction intersecting the radial direction of the annular feeding path Ru.

The parallel direction leading portion 55 extends along the axial direction of the annular feeding path Ru so that an introduction portion 55*a* of the upstream side extends along the direction in which the two wires W fed by the wire feeding portion 3A are parallel to each other in the feeding direction of the wire W fed in the forward direction indicated by the arrow F. Further, the parallel direction leading portion 55 is inclined in a predetermined direction with respect to the radial direction of the annular feeding path Ru in a direction in which a lead-out portion 55*b* of the downstream side connected to the parallel guide portion 54 approaches the direction along the radial direction of the annular feeding path Ru.

In this example, in the parallel direction leading portion 55, in the lead-out portion 55*b*, with respect to a first leading portion 55*b*1 in contact with the one wire W, a second leading portion 55*b*2 in contact with the other wire W protrudes to an inner peripheral side along the radial direction of the annular feeding path Ru.

Thus, the parallel direction leading portion 55 is formed of a surface inclined so as to be twisted in a direction gradually approaching the direction along the radial direction of the annular feeding path Ru from the introduction portion 55*a* toward the lead-out portion 55*b*.

Therefore, of the two wires W fed by the wire feeding portion 3A and passing through the parallel direction leading portion 55, the curl guide 50*a* leads, with respect to the one wire W in contact with the first leading portion 55*b*1, the other wire W in contact with the second leading portion 55*b*2 toward the inner peripheral side along the radial direction of the annular feeding path Ru. The one wire W in contact with the first leading portion 55*b*1 is in contact with the feeding gear 30L on the driving side, and the other wire W in contact with the second leading portion 55*b*2 is in contact with the feeding gear 30R on the driven side.

Then, the curl guide 50*a* maintains a state of being arranged in the radial direction of the annular feeding path Ru by causing the two wires W led by the parallel direction leading portion 55 to be arranged in the radial direction of the annular feeding path Ru to pass through the parallel guide portion 54.

The curl guide 50*a* includes a feeding direction leading portion 57 that leads the wire W to the leading guide 50*b*. The feeding direction leading portion 57 is provided on a distal end side of the curl guide 50*a* with respect to the feeding direction of the wire W fed in the forward direction. When the wire W is fed in the forward direction by the wire feeding portion 3A, the feeding direction leading portion 57 leads the wire W fed from the curl guide 50*a* in the first direction indicated by the arrow C1 along the axial direction of the annular feeding path Ru. The first direction indicated by the arrow C1 is a direction in which the magazine 2A and the reel 20 are offset.

In the curl guide 50*a*, a fourth wire guide 58 is attached to a distal end side of the second wire guide 52. The fourth wire guide 58 may be detachably attached to the curl guide 50*a*.

The feeding direction leading portion 57 includes a fourth guide surface 58*a* formed by the fourth wire guide 58 and a fifth guide surface 53*b* of the third wire guide 53. In the feeding direction leading portion 57, the fourth guide surface 58*a* is connected to the second guide surface 52*a* of the second wire guide 52, and the fifth guide surface 53*b* is connected to the third guide surface 53*a* of the third wire guide 53.

The feeding direction leading portion 57 includes a sixth guide surface 58*b* formed by the fourth wire guide 58. In the feeding direction leading portion 57, the sixth guide surface 58*b* is connected to the first guide surface 51*a* of the first wire guide 51.

Thus, the feeding direction leading portion 57 is formed of a groove portion having a shape in which the fourth guide surface 58*a* and the fifth guide surface 53*b* are opposed to each other with a predetermined interval therebetween on both sides along the axial direction of the annular feeding path Ru, and the outer peripheral side along the radial direction of the annular feeding path Ru is closed by the sixth guide surface 58*b* between the fourth guide surface 58*a* and the fifth guide surface 53*b*.

The feeding direction leading portion 57 is formed by inclining a part of the distal end side of the curl guide 50*a* in the first direction (magazine offset direction) indicated by the arrow C1. That is, the feeding direction leading portion 57 is inclined in the first direction indicated by the arrow C1 with respect to an extension direction along the peripheral direction of the annular feeding path Ru of the parallel guide portion 54, and is connected to the parallel guide portion 54. Thus, the parallel guide portion 54 of the curl guide 50*a* is bent in the first direction along the axial direction of the annular feeding path Ru at a portion where the parallel guide portion 54 and the feeding direction leading portion 57 are connected to each other. An inclination angle of the feeding direction leading portion 57 in the first direction is preferably 3° or more and 7° or less. The inclination angle of the feeding direction leading portion 57 is an angle with respect to the extension direction of the parallel guide portion 54, and the extension direction of the parallel guide portion 54 is a direction along the peripheral direction of the annular feeding path Ru defined by the curl guide 50*a*.

In the feeding direction leading portion 57, an interval (width) between the fourth guide surface 58*a* and the fifth guide surface 53*b* is set to be greater than the diameter Rb of the wire W and smaller than twice the diameter Rb of the wire W, similarly to the parallel guide portion 54.

Configuration Example of Cutting Portion

Figure 3:
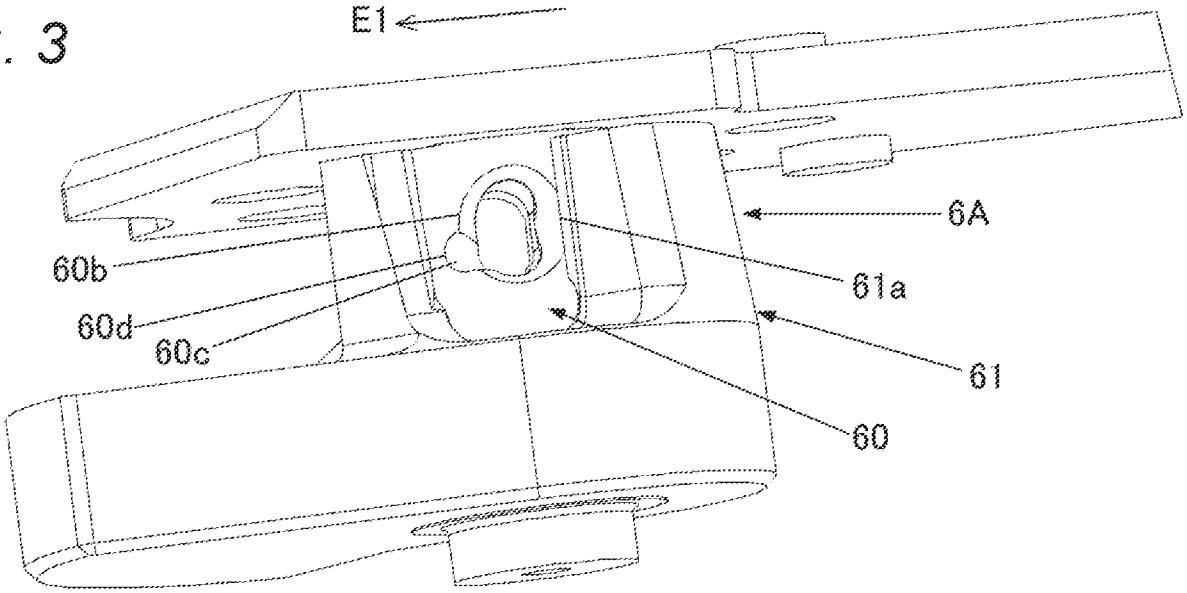
FIG. 3 is a perspective view illustrating an example of a cutting portion.

FIG. 3 is a perspective view illustrating an example of a cutting portion. Next, an example of the cutting portion 6A will be described with reference to the drawings.

The fixed blade portion 60 is provided on the downstream side of the wire guide 4A with respect to the feeding direction of the wire W fed in the forward direction. The fixed blade portion 60 is formed of a cylindrical member serving as an axis of rotation of the movable blade portion 61 and includes an opening 60*a* penetrating in the radial direction of the cylindrical shape. The opening 60*a* has a long hole shape along a direction in which the two wires W fed by the wire feeding portion 3A are arranged in parallel.

The movable blade portion 61 is supported to be rotatable about the fixed blade portion 60 and includes a blade portion 61*a* which is in sliding contact with an opening end of the opening 60*a* of the fixed blade portion 60 by a rotating operation with the fixed blade portion 60 as an axis.

The fixed blade portion 60 includes a first abutting blade portion 60*b* and a second abutting blade portion 60*c* at the opening end of the opening 60*a* with which the blade portion 61*a* of the movable blade portion 61 sliding contacts. The fixed blade portion 60 is provided with the first abutting blade portion 60*b* and the second abutting blade portion 60*c* along the direction in which the two wires W are arranged in parallel.

The fixed blade portion 60 is provided with the first abutting blade portion 60*b* on the front side and the second abutting blade portion 60*c* on the back side with respect to a moving direction of the blade portion 61*a* indicated by an arrow E1 by the rotating operation of the movable blade portion 61 with the fixed blade portion 60 as the axis. The fixed blade portion 60 includes a retraction recess 60*d* extending from the opening 60*a* to the second abutting blade portion 60*c*. The retraction recess 60*d* is formed by providing a recessed portion recessed from the opening 60*a* toward the second abutting blade portion 60*c* in a shape in which one wire W enters an inner peripheral surface of the opening 60*a*. The amount of retracting the second abutting blade portion 60*c* of the fixed blade portion 60 with respect to the first abutting blade portion 60*b* is preferably about half of the diameter of the wire W.

In the cutting portion 6A, the blade portion 61*a* of the movable blade portion 61 is in sliding contact with the opening end of the opening 60*a* of the fixed blade portion 60 by the rotating operation of the movable blade portion 61 with the fixed blade portion 60 as the axis. In the cutting portion 6A, when the blade portion 61*a* is moved from a standby position in the direction of the arrow E1 in a state where the two wires W are passed through the opening 60*a*, the one wire W of the two parallel wires W is pressed against the first abutting blade portion 60*b* by the blade portion 61*a* and is cut by applying a shearing force. The other wire W of the two parallel wires W is pressed and bent by the blade portion 61*a*, enters the retraction recess 60*d*, and then is pressed against the second abutting blade portion 60*c* by the blade portion 61*a*, and is cut by applying the shearing force.

Configuration Example of Binding Portion

Figure 4A:
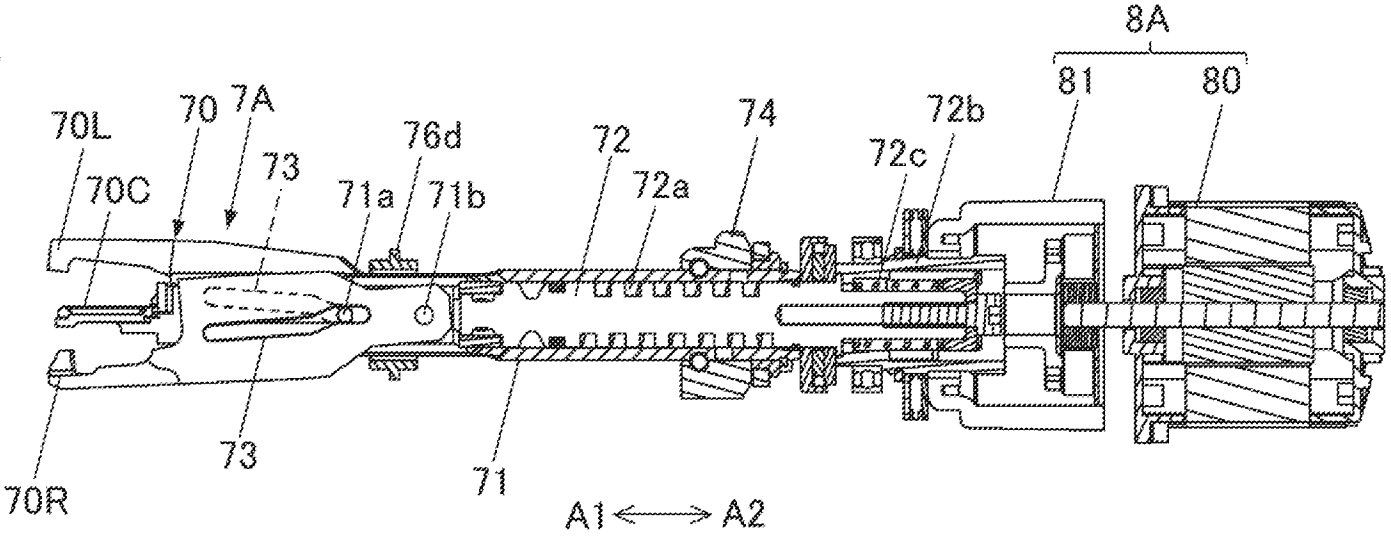
FIG. 4A is a cross-sectional plan view illustrating an example of the binding portion and a driving portion.
Figure 4B:
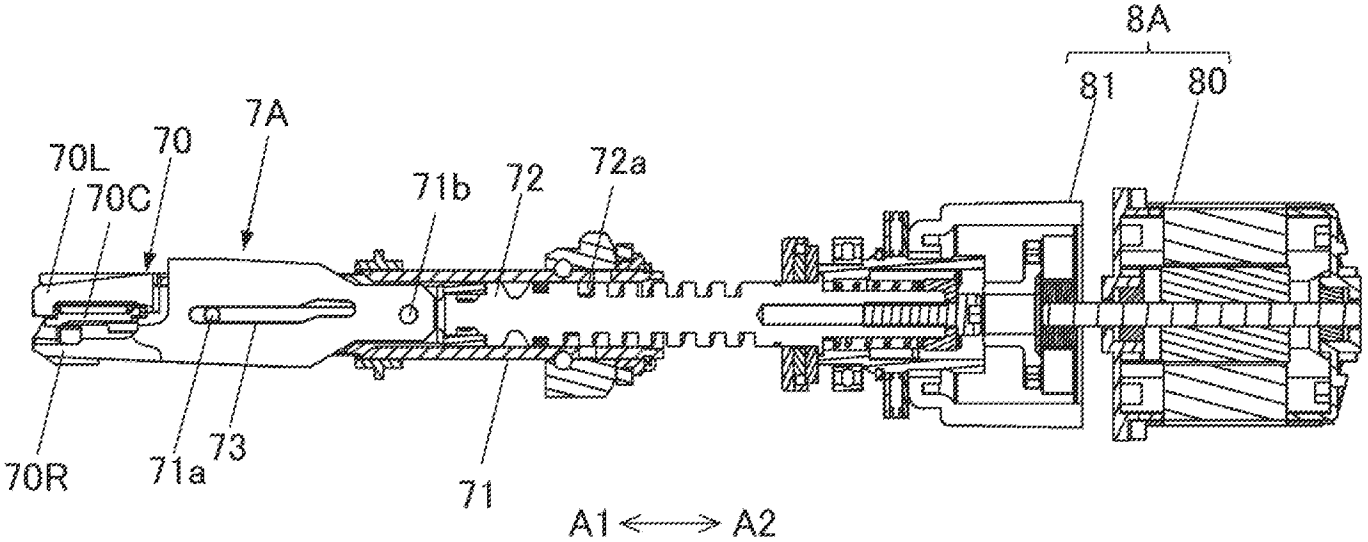
FIG. 4B is a cross-sectional plan view illustrating the example of the binding portion and the driving portion.

FIGS. 4A and 4B are cross-sectional plan views illustrating an example of a binding portion and a driving portion. Next, configurations of the binding portion 7A and the driving portion 8A will be described with reference to the drawings.

The binding portion 7A includes a rotation shaft 72 that actuates the wire locking body 70 and the sleeve 71. The rotation shaft 72 is coupled to the speed reducer 81 via a coupling portion 72*b* that is rotatable integrally with the speed reducer 81 and is movable in the axial direction with respect to the speed reducer 81. The coupling portion 72*b* includes a spring 72*c* that biases the rotation shaft 72 rearward, which is a direction approaching the speed reducer 81, and regulates a position of the rotation shaft 72 along the axial direction. Thus, the rotation shaft 72 is movable forward, which is a direction away from the speed reducer 81, while receiving a force to be pressed rearward by the spring 72*c*. Accordingly, when a force for moving the wire locking body 70 forward along the axial direction is applied to the rotation shaft 72, the rotation shaft 72 can move forward while receiving the force to be pressed rearward by the spring 72*c*.

The wire locking body 70 includes a center hook 70C coupled to the rotation shaft 72, and a first side hook 70R and a second side hook 70L that open and close with respect to the center hook 70C.

The center hook 70C is coupled to a distal end of the rotation shaft 72, which is one end portion of the rotation shaft 72 in an axial direction, via a configuration capable of rotating with respect to the rotation shaft 72 and capable of moving integrally with the rotation shaft 72 in the axial direction.

In the wire locking body 70, by a rotation operation with a shaft 71*b* as a fulcrum, a distal end side of the first side hook 70R opens and closes in a direction in which the distal end side of the first side hook 70R comes into contact with or separates from the center hook 70C. A distal end side of the second side hook 70L opens and closes in a direction in which the distal end side of the second side hook 70L comes into contact with or separates from the center hook 70C.

The sleeve 71 includes a convex portion (not illustrated) protruding to an inner peripheral surface of a space into which the rotation shaft 72 is inserted, and the convex portion enters a groove portion of a feeding screw 72*a* formed along the axial direction on an outer periphery of the rotation shaft 72. The sleeve 71 is supported by a support member 76*d* to be rotatable and slidable in the axial direction. When the rotation shaft 72 rotates, the sleeve 71 is moved in a direction along the axial direction of the rotation shaft 72, in accordance with a rotation direction of the rotation shaft 72 due to an action of the convex portion (not illustrated) and the feeding screw 72*a* of the rotation shaft 72. The sleeve 71 rotates integrally with the rotation shaft 72.

The sleeve 71 includes an opening and closing pin 71*a* that opens and closes the first side hook 70R and the second side hook 70L.

The opening and closing pin 71*a* is inserted into an opening and closing guide hole 73 provided in the first side hook 70R and the second side hook 70L. The opening and closing guide hole 73 extends along the moving direction of the sleeve 71 and has a shape that converts a linear motion of the opening and closing pin 71*a* that is moved in conjunction with the sleeve 71 into an opening and closing operation due to rotation of the first side hook 70R and the second side hook 70L with the shaft 71*b* as a fulcrum.

In the wire locking body 70, when the sleeve 71 is moved in a downward direction indicated by the arrow A2, the first side hook 70R and the second side hook 70L are moved in a direction away from the center hook 70C by the rotation operation with the shaft 71*b* as a fulcrum due to a trajectory of the opening and closing pin 71*a* and the shape of the opening and closing guide hole 73.

Accordingly, the first side hook 70R and the second side hook 70L are opened with respect to the center hook 70C, and a feeding path through which the wire W passes is respectively formed between the first side hook 70R and the center hook 70C and between the second side hook 70L and the center hook 70C.

In the state in which the first side hook 70R and the second side hook 70L are opened with respect to the center hook 70C, the wire W fed by the wire feeding portion 3A passes between the center hook 70C and the first side hook 70R. The wire W that passes between the center hook 70C and the first side hook 70R is led to the curl forming portion 5A. The wire W curled by the curl guide 50*a* and led to the binding portion 7A by the leading guide 50*b* passes between the center hook 70C and the second side hook 70L.

In the wire locking body 70, when the sleeve 71 is moved in an upward direction indicated by the arrow A1, the first side hook 70R and the second side hook 70L are moved in a direction in which the first side hook 70R and the second side hook 70L approach the center hook 70C by the rotation operation with the shaft 71*b* as a fulcrum due to the trajectory of the opening and closing pin 71*a* and the shape of the opening and closing guide hole 73. Accordingly, the first side hook 70R and the second side hook 70L are closed with respect to the center hook 70C.

When the first side hook 70R is closed with respect to the center hook 70C, the wire W sandwiched between the first side hook 70R and the center hook 70C is locked in a manner of being capable of moving between the first side hook 70R and the center hook 70C. When the second side hook 70L is closed with respect to the center hook 70C, the wire W sandwiched between the second side hook 70L and the center hook 70C is locked in a manner that the wire W is not removed from a portion between the second side hook 70L and the center hook 70C.

The sleeve 71 includes a bent portion 71*c*1 that forms the wire W into a predetermined shape by pressing and bending a distal end side, which is one end portion of the wire W, in the predetermined direction, and a bent portion 71*c*2 that forms the wire W into a predetermined shape by pressing and bending a terminal end side, which is the other end portion of the wire W cut by the cutting portion 6A, in the predetermined direction.

When the sleeve 71 is moved in the upward direction indicated by the arrow A1, the distal end side of the wire W locked by the center hook 70C and the second side hook 70L is pressed by the bent portion 71*c*1 and bent toward the reinforcing bar S. When the sleeve 71 is moved in the upward direction indicated by the arrow A1, the terminal end side of the wire W, which is locked by the center hook 70C and the first side hook 70R and cut by the cutting portion 6A, is pressed by the bent portion 71*c*2 and bent toward the reinforcing bar S.

The binding portion 7A includes a rotation regulating portion 74 that regulates the rotations of the wire locking body 70 and the sleeve 71 which are in conjunction with a rotation operation of the rotation shaft 72. In the binding portion 7A, the rotation regulating portion 74 regulates the rotation of the sleeve 71 which is in conjunction with the rotation of the rotation shaft 72 according to a position of the sleeve 71 along the axial direction of the rotation shaft 72, and the sleeve 71 is moved in the directions indicated by the arrows A1 and A2 by the rotation operation of the rotation shaft 72.

Accordingly, the sleeve 71 is moved in the direction indicated by the arrow A1 without rotating, whereby the first side hook 70R and the second side hook 70L are closed with respect to the center hook 70C, and the wire W is locked. The sleeve 71 is moved in the direction indicated by the arrow A2 without rotating, whereby the first side hook 70R and the second side hook 70L are opened with respect to the center hook 70C, and the locking of the wire W is released.

In the binding portion 7A, when the regulation of the rotation of the sleeve 71 by the rotation regulating portion 74 is released, the sleeve 71 rotates in conjunction with the rotation of the rotation shaft 72.

Accordingly, the first side hook 70R and the second side hook 70L, which lock the wire W, and the center hook 70C rotate, and the locked wire W is twisted.

Operation Example of Reinforcing Bar Binding Machine According to First Embodiment FIGS. 5A, 5B, 5C, and 5D are perspective views illustrating an example of an operation of cutting the wire by a cutting portion. Next, an operation of cutting the wire W by the cutting portion 6A in a process of the operation of binding the reinforcing bars S with the wire W will be described with reference to the drawings.

Figure 5A:
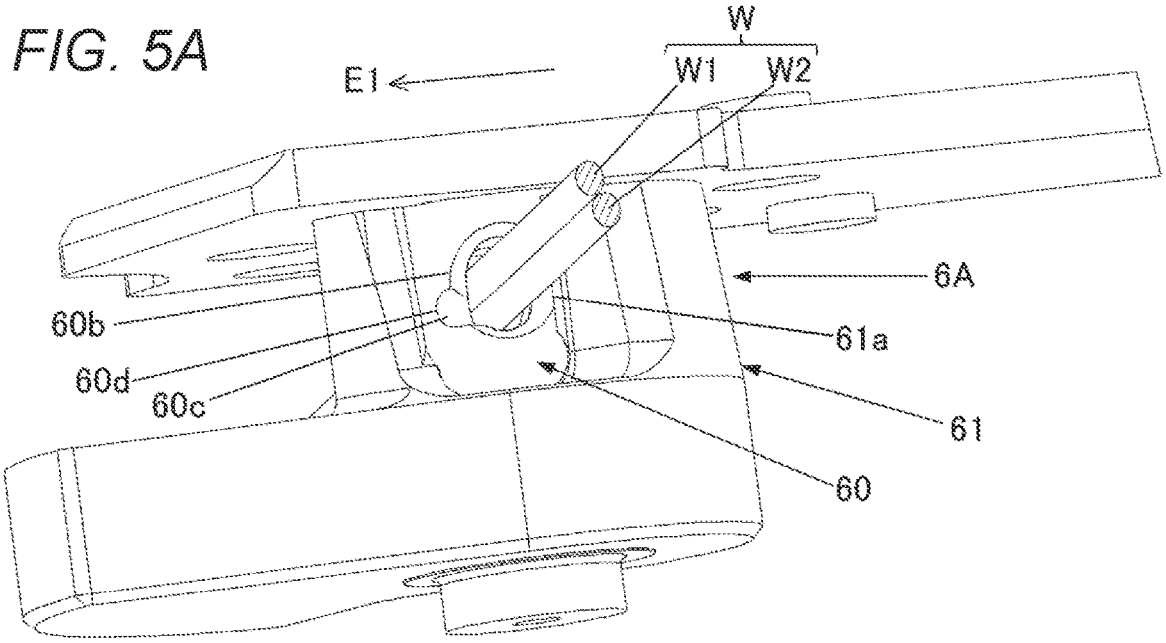
FIG. 5A is a perspective view illustrating an example of an operation of cutting a wire by the cutting portion.

As illustrated in FIG. 5A, in the cutting portion 6A, in a state where the blade portion 61*a* of the movable blade portion 61 is moved to the standby position, the two wires W fed by the wire feeding portion 3A are passed to the opening 60*a* of the fixed blade portion 60. A direction in which the two wires W passed through the opening 60*a* are parallel to each other is a direction along the axial direction intersecting the radial direction of the annular feeding path Ru illustrated in FIG. 1A and the like.

In the cutting portion 6A, in a state in which the two wires W are passed through the opening 60*a* of the fixed blade portion 60, the blade portion 61*a* of the movable blade portion 61 is moved from the standby position in the direction of the arrow E1 by the rotation operation of the movable blade portion 61 with the fixed blade portion 60 as the axis. The rotation operation of the movable blade portion 61 is in conjunction with the operation of the binding portion 7A described later.

When the blade portion 61*a* of the movable blade portion 61 is moved from the standby position in the direction of the arrow E1, the one wire W1 of the two parallel wires W is pressed against the first abutting blade portion 60*b* of the fixed blade portion 60 by the blade portion 61*a*. The other wire W2 is pressed by the blade portion 61*a* to be bent along the moving direction of the blade portion 61*a* and enters the retraction recess 60*d* of the fixed blade portion 60. Accordingly, a shearing force is applied to the one wire W1, and cutting of the one wire W1 is started before the other wire W2.

When the blade portion 61*a* is moved in the direction of the arrow E1 by the rotation operation of the movable blade portion 61 with the fixed blade portion 60 as the axis, when the one wire W1 is cut to a predetermined position after the cutting of the one wire W1 is started, the other wire W2 is pressed against the second abutting blade portion 60*c* by the blade portion 61*a*. Thus, cutting of the other wire W2 is started.

Figure 5B:
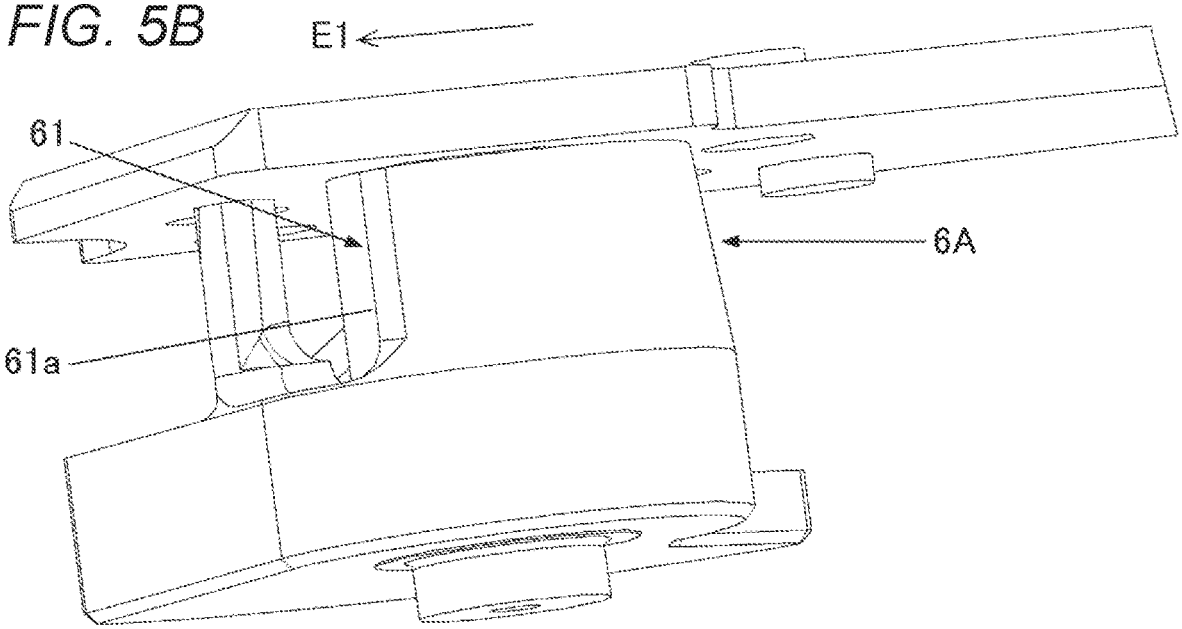
FIG. 5B is a perspective view illustrating the example of the operation of cutting the wire by the cutting portion.

When the blade portion 61*a* is further moved in the direction of the arrow E1 by the rotation operation of the movable blade portion 61 with the fixed blade portion 60 as the axis, the cutting of the one wire W1 whose cutting is started earlier is completed. When the blade portion 61*a* is further moved in the direction of the arrow E1 and is moved to a cutting completion position as illustrated in FIG. 5B, the cutting of the other wire W2 whose cutting is started later is completed.

Figure 5C:
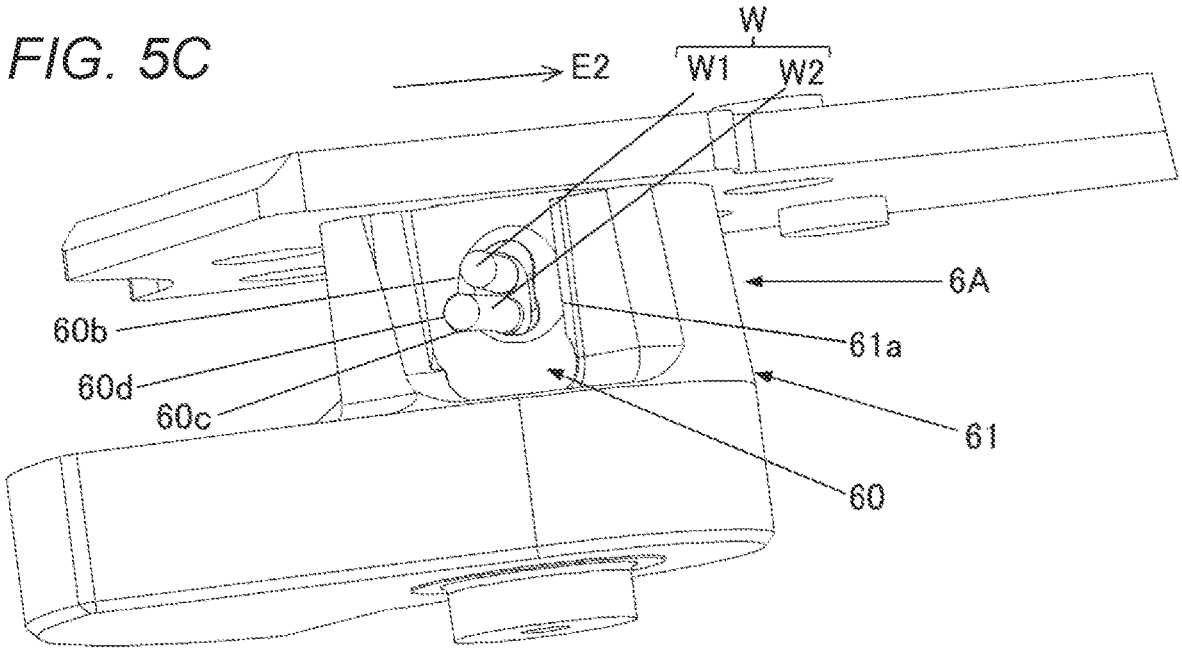
FIG. 5C is a perspective view illustrating the example of the operation of cutting the wire by the cutting portion.
Figure 5D:
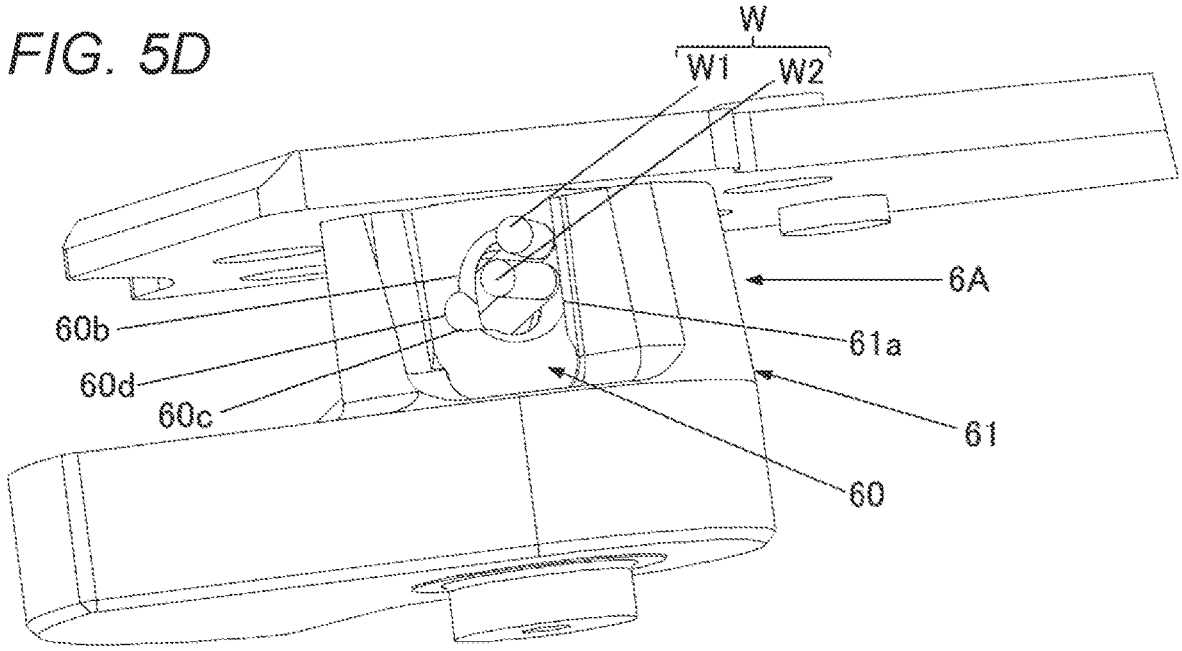
FIG. 5D is a perspective view illustrating the example of the operation of cutting the wire by the cutting portion.

When the cutting of the wire W is completed, the blade portion 61*a* is moved in a direction of an arrow E2 by the rotation operation of the movable blade portion 61 with the fixed blade portion 60 as the axis, and returns to the standby position as illustrated in FIG. 5C. In the two wires W cut by the above-described operation of the cutting portion 6A, the distal end side of the other wire W2 is bent along the moving direction of the blade portion 61*a* with respect to the one wire W1. As illustrated in FIG. 5D, a direction in which the distal end side of the other wire W2 is bent is a direction facing the inner peripheral side of the annular feeding path Ru when the wire W is fed in the forward direction and the distal end of the wire W reaches the curl guide 50*a*. The one wire W1 is fed in contact with the feeding gear 30L on the driving side, and the other wire W2 is fed in contact with the feeding gear 30R on the driven side.

Figure 6A:
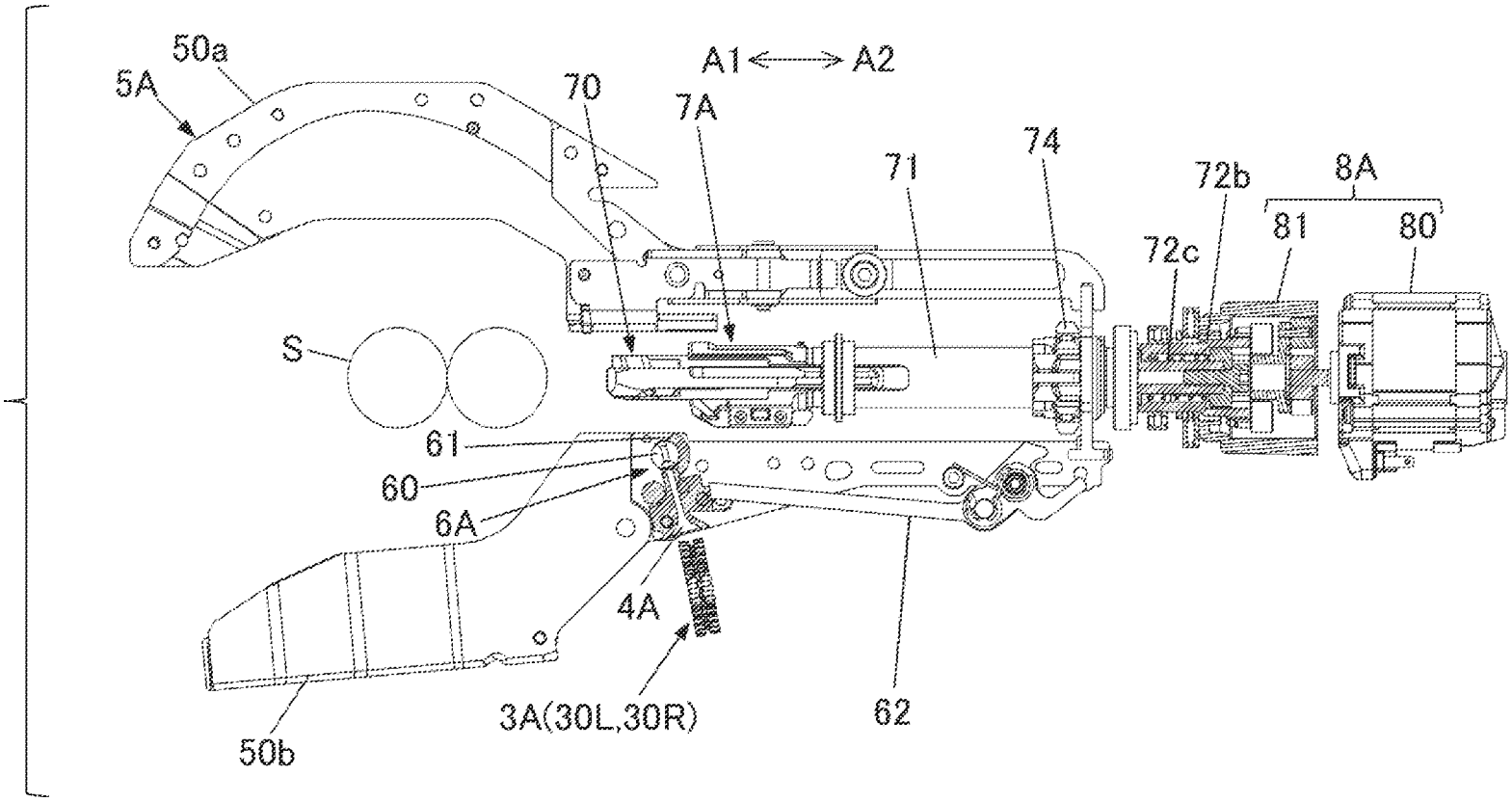
FIG. 6A is a main portion side cross-sectional view illustrating an example of an operation of the reinforcing bar binding machine according to the first embodiment.
Figure 6B:
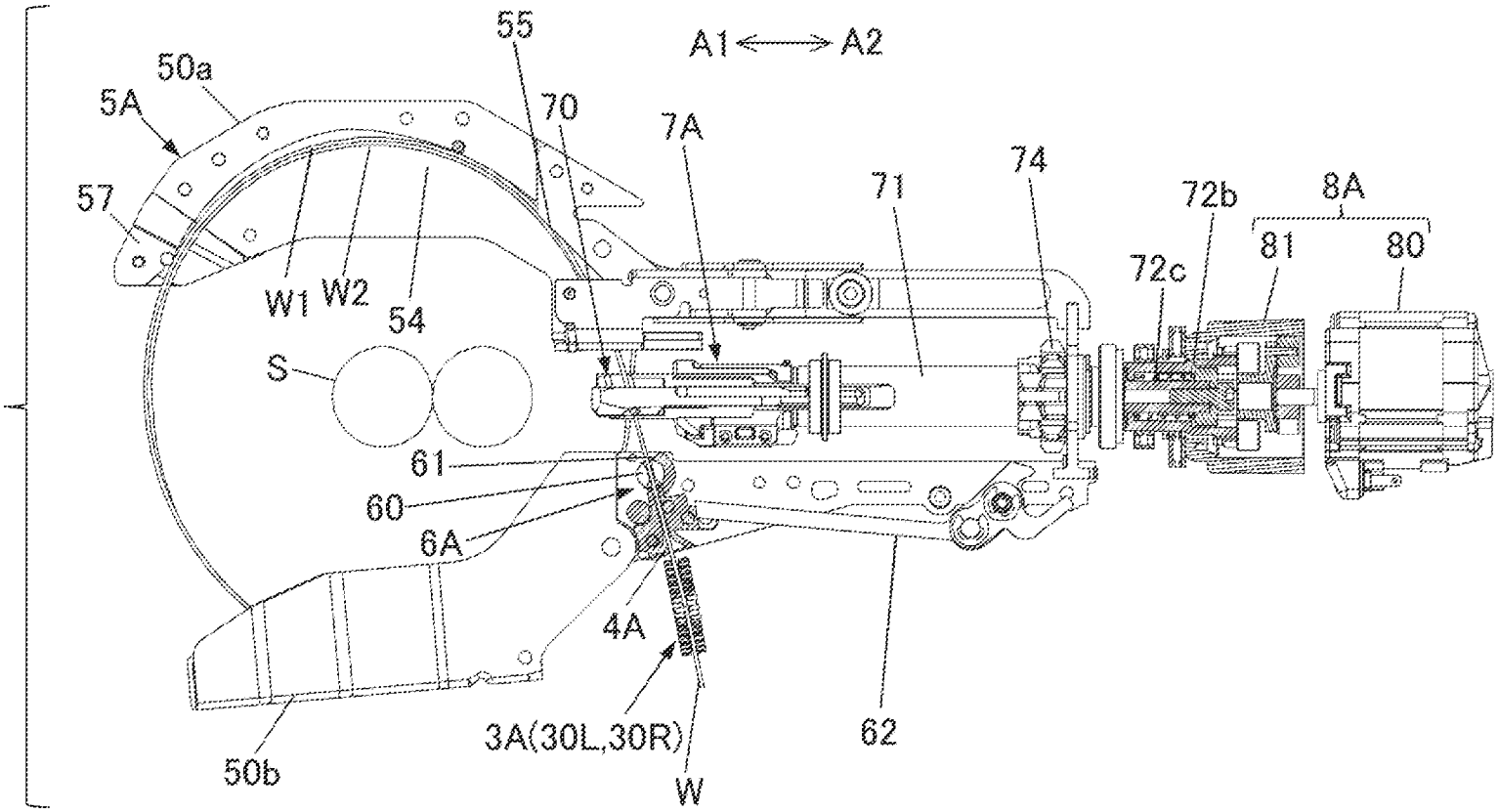
FIG. 6B is a main portion side cross-sectional view illustrating the example of the operation of the reinforcing bar binding machine according to the first embodiment.
Figure 6C:
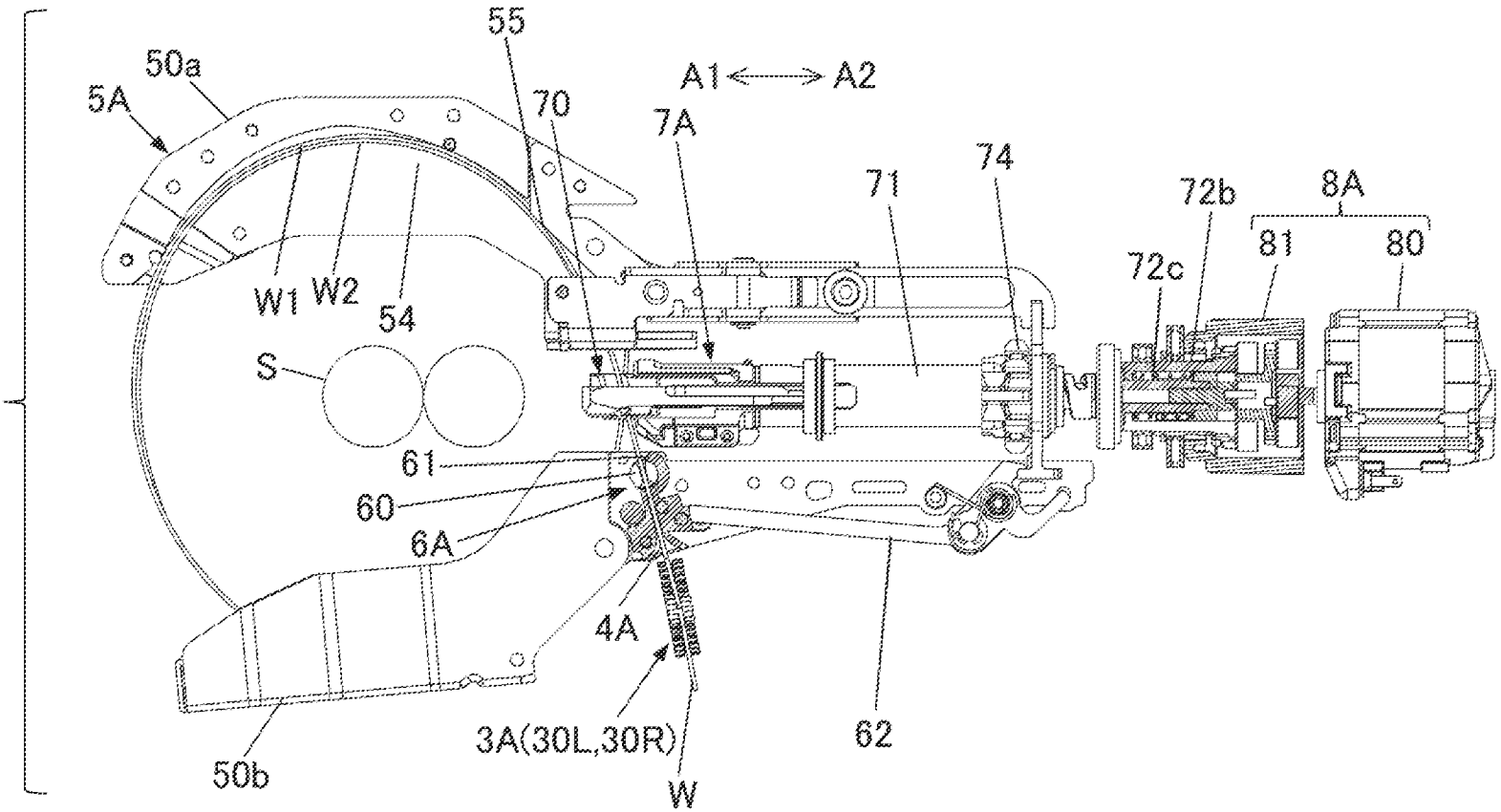
FIG. 6C is a main portion side cross-sectional view illustrating the example of the operation of the reinforcing bar binding machine according to the first embodiment.
Figure 6D:
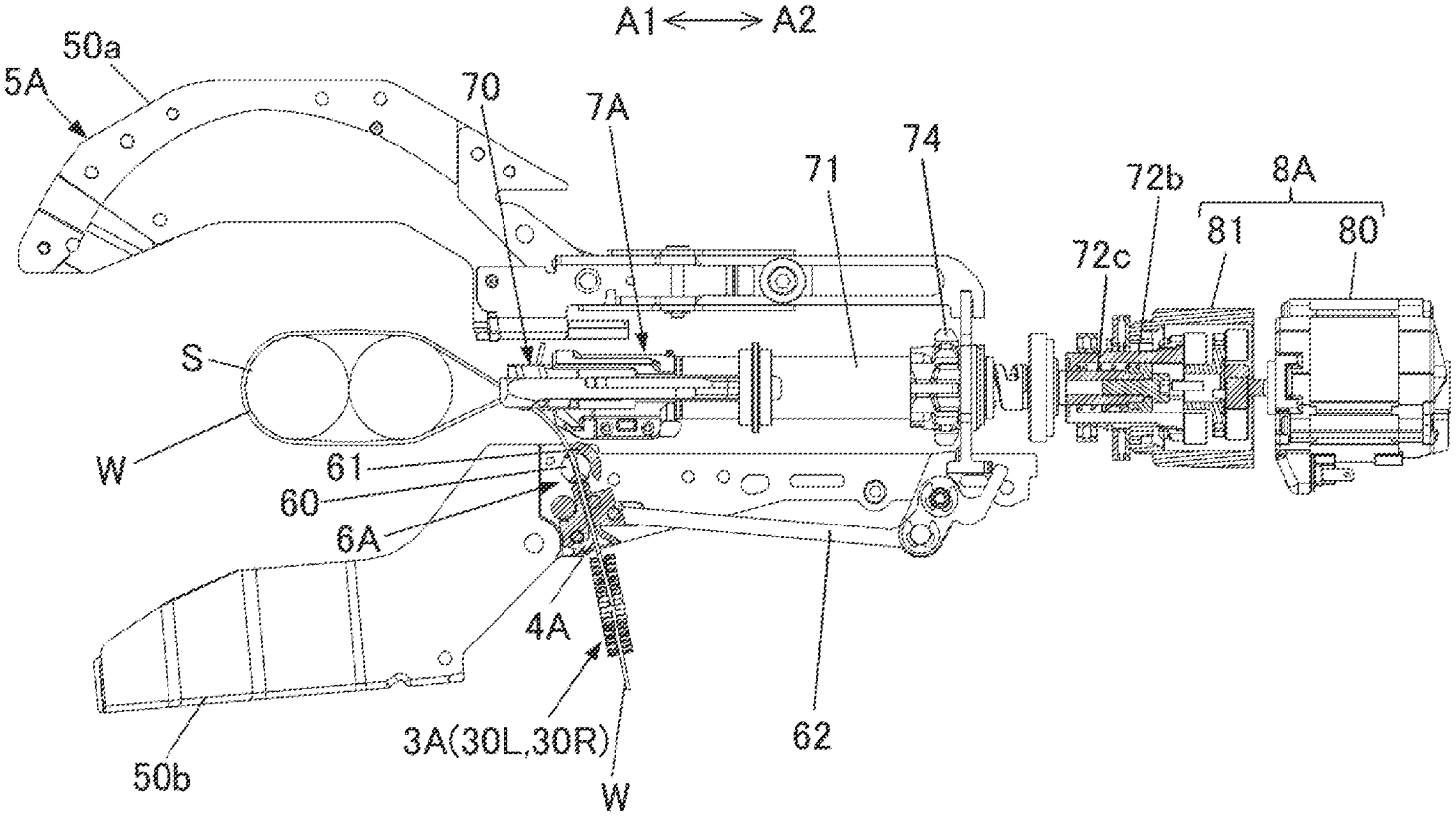
FIG. 6D is a main portion side cross-sectional view illustrating the example of the operation of the reinforcing bar binding machine according to the first embodiment.
Figure 6E:
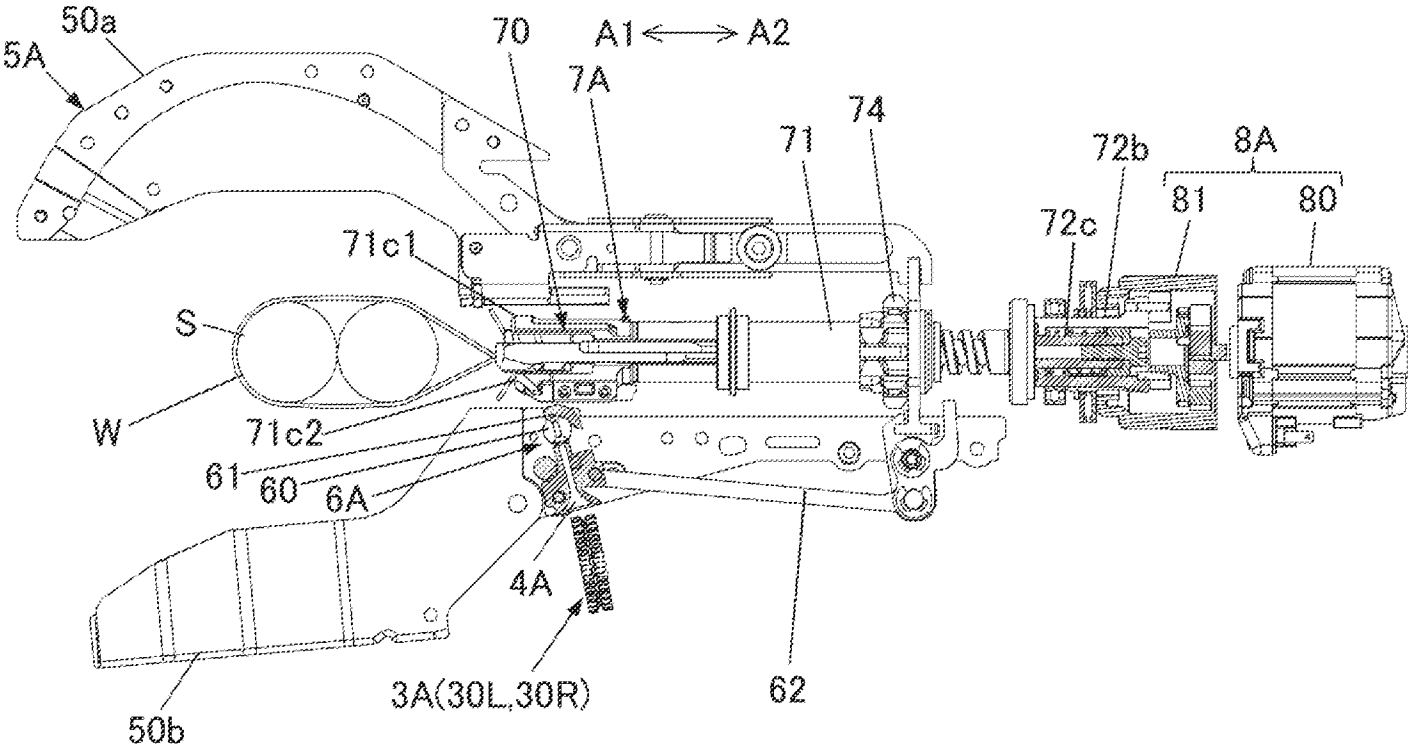
FIG. 6E is a main portion side cross-sectional view illustrating the example of the operation of the reinforcing bar binding machine according to the first embodiment.
Figure 6F:
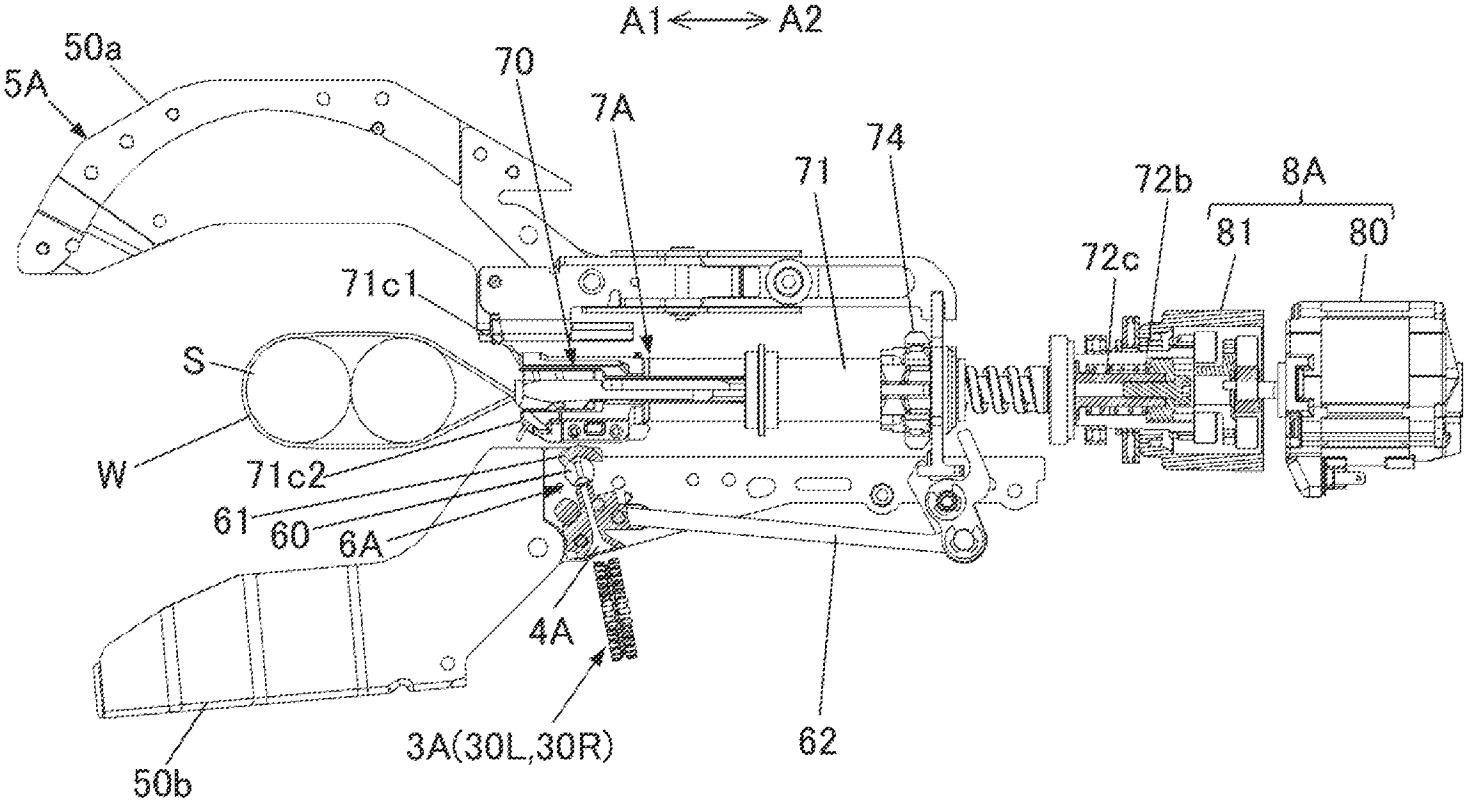
FIG. 6F is a main portion side cross-sectional view illustrating the example of the operation of the reinforcing bar binding machine according to the first embodiment.
Figure 6G:
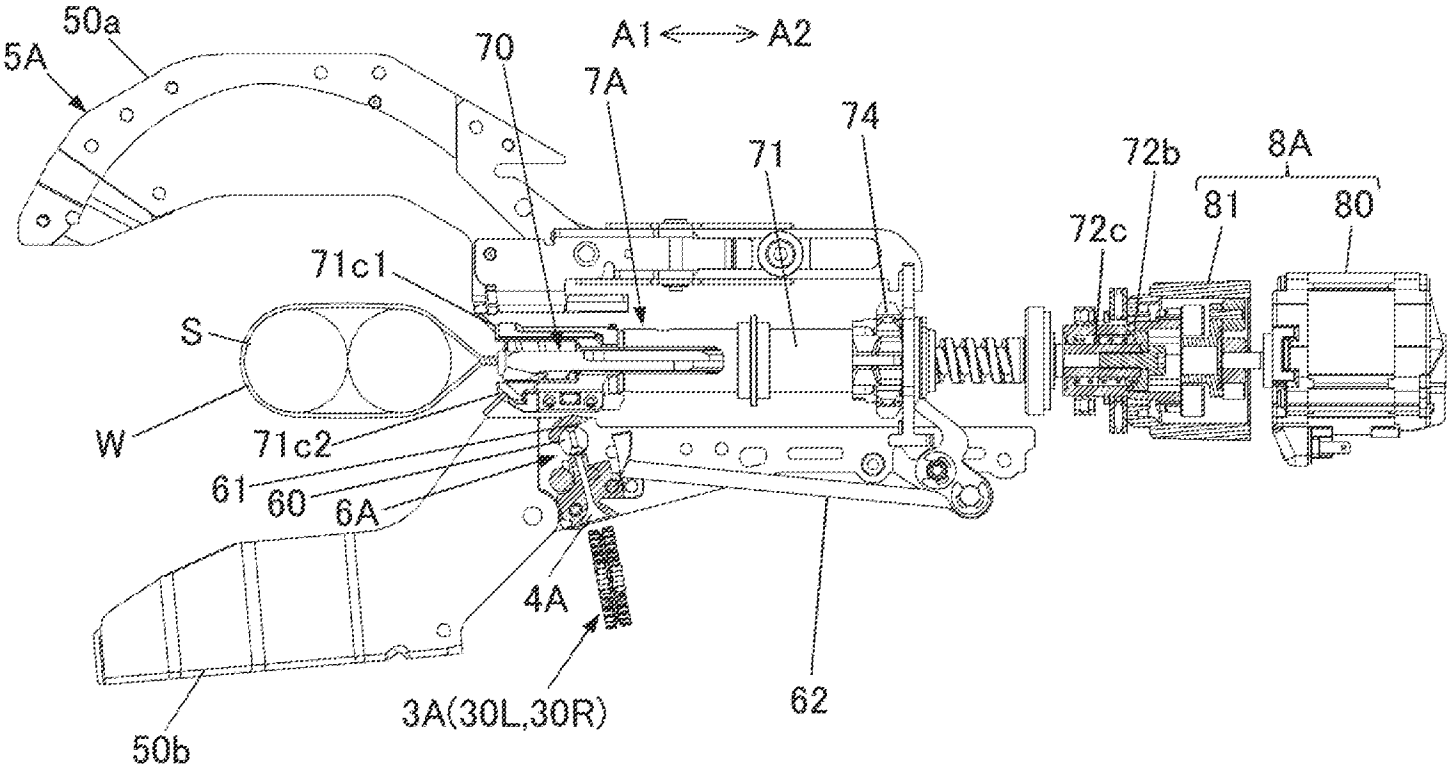
FIG. 6G is a main portion side cross-sectional view illustrating the example of the operation of the reinforcing bar binding machine according to the first embodiment.
Figure 6H:
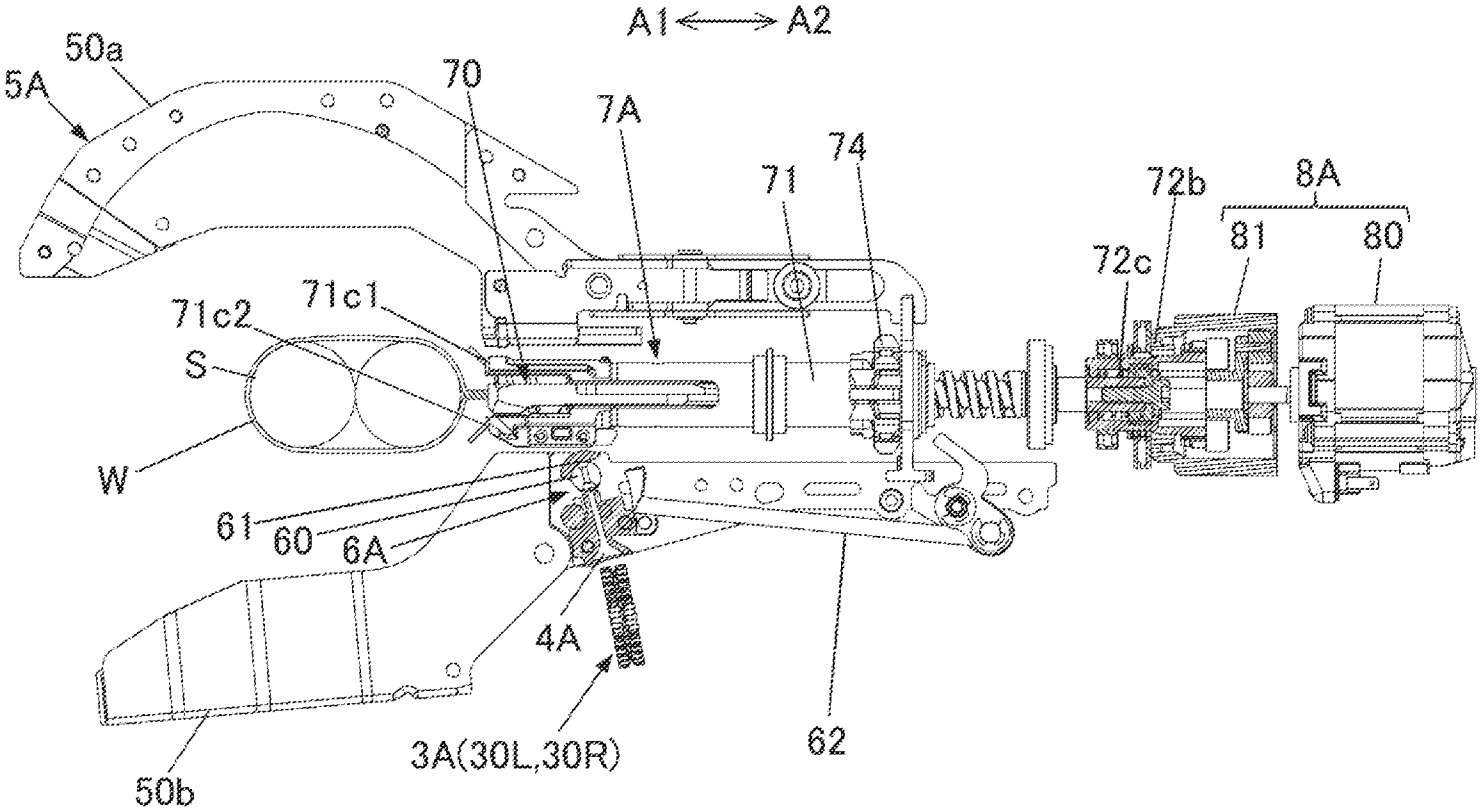
FIG. 6H is a main portion side cross-sectional view illustrating the example of the operation of the reinforcing bar binding machine according to the first embodiment.

FIGS. 6A, 6B, 6C, 6D, 6E, 6F, 6G, and 6H are main portion side cross-sectional views illustrating an example of an operation of the reinforcing bar binding machine according to the first embodiment. FIG. 6A illustrates a state in which the reinforcing bars S are inserted at a position where binding is possible. FIG. 6B illustrates an operation of feeding the wire W in the forward direction and winding the wire W around the reinforcing bars S. FIG. 6C illustrates an operation of locking the wire W wound around the reinforcing bars S. FIG. 6D illustrates an operation of feeding the wire W in the reverse direction and winding the wire W around the reinforcing bars S. FIG. 6E illustrates an operation of cutting a surplus of the wire W wound around the reinforcing bars S. FIG. 6F illustrates an operation of bending the wire W wound around the reinforcing bars S. FIGS. 6G and 6H illustrate an operation of twisting the wire W wound around the reinforcing bars S.

Next, an operation of binding the reinforcing bars S with the wire W by the reinforcing bar binding machine 1A according to the first embodiment will be described with reference to the drawings.

In the reinforcing bar binding machine 1A, a state in which the two wires W are sandwiched between the pair of feeding gears 30 (30L and 30R) and the distal end of each wire W is positioned between a sandwich position of the feeding gears 30 (30L and 30R) and the fixed blade portion 60 of the cutting portion 6A is a standby state. Further, in the reinforcing bar binding machine 1A, in the standby state, the sleeve 71 and the wire locking body 70 having the first side hook 70R, the second side hook 70L, and the center hook 70C attached to the sleeve 71 move in the rear direction indicated by the arrow A2, and as illustrated in FIG. 4A, the first side hook 70R opens with respect to the center hook 70C, and the second side hook 70L opens with respect to the center hook 70C.

As illustrated in FIG. 6A, when the reinforcing bars S are inserted between the curl guide 50*a* and the leading guide 50*b* of the curl forming portion 5A and the trigger 12A is operated, the feeding motor 31 is driven in the forward rotation direction, and as illustrated in FIG. 6B, the two wires W are fed in the forward direction indicated by an arrow F in the wire feeding portion 3A.

On the upstream side of the curl guide 50*a*, the two wires W fed in the forward direction by the wire feeding portion 3A are arranged in parallel along the axial direction of the annular feeding path Ru by the wire guide 4A.

The two wires W fed in the forward direction pass between the center hook 70C and the first side hook 70R and are fed to the curl guide 50*a* of the curl forming portion 5A. By passing through the curl guide 50*a*, the two wires W are curled to be wound around the reinforcing bars S along the annular feeding path Ru. Further, by passing through the curl guide 50*a*, the two wires W are led to be arranged in the radial direction of the annular feeding path Ru. Furthermore, the two wires W passes through the curl guide 50*a* in the state of being arranged in the radial direction of the annular feeding path Ru.

Figure 7A:
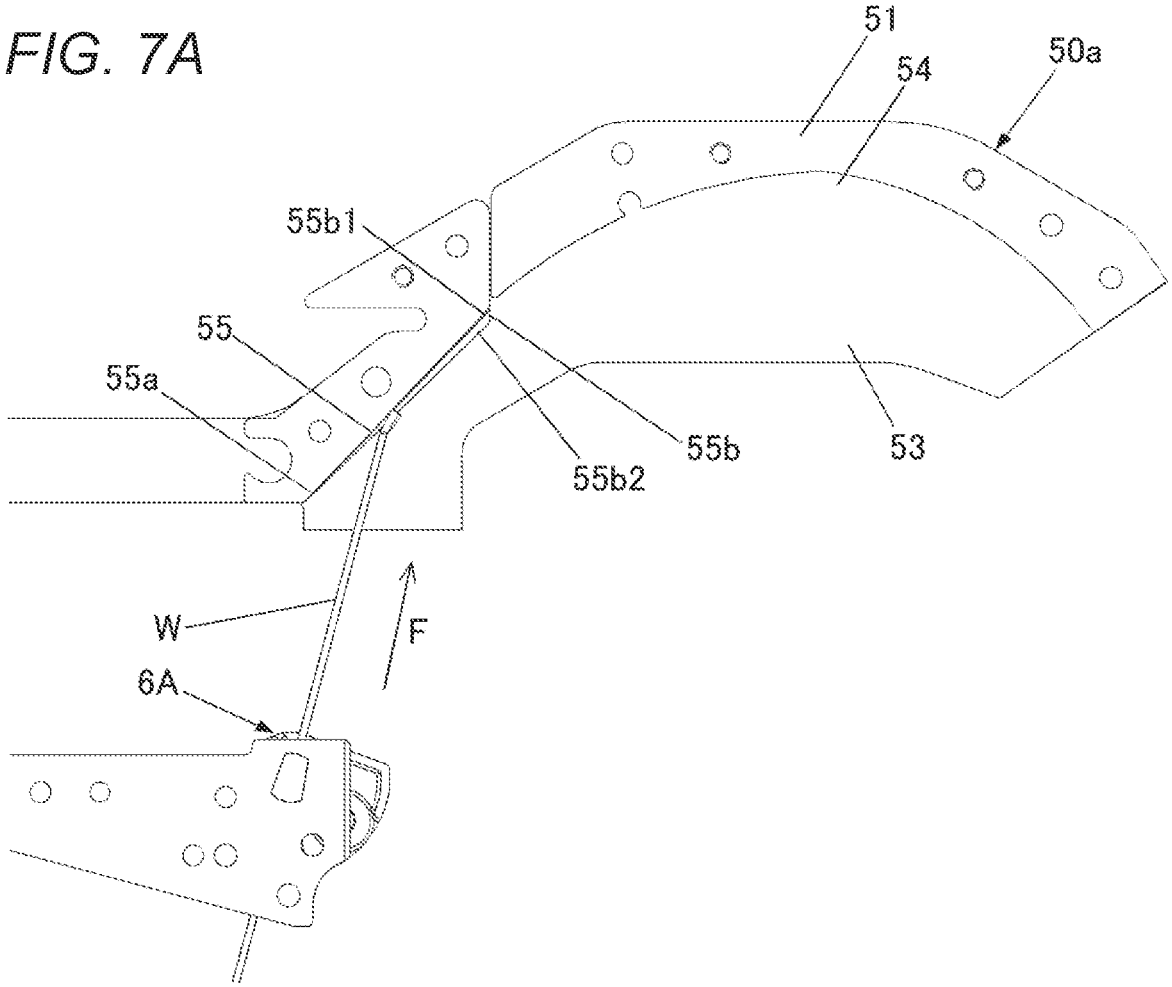
FIG. 7A is a side view illustrating an example of an operation of leading the wire in a parallel direction in the curl guide.

FIG. 7A is a side view illustrating an example of an operation of leading the wire in a parallel direction in the curl guide, FIG. 7B is an enlarged side view of a main portion illustrating the example of the operation of leading the wire in the parallel direction in the curl guide, and FIG. 7C is an enlarged perspective view of the main portion illustrating the example of the operation of leading the wire in the parallel direction in the curl guide.

In the operation of cutting the two wires W by the cutting portion 6A described above, at the distal end side of the two cut wires W, when the distal end of the wire W reaches the curl guide 50*a*, with respect to the one wire W1 fed in contact with the feeding gear 30L on the driving side, the distal end side of the other wire W2 fed in contact with the feeding gear 30R on the driven side is bent in a direction facing the inner peripheral side of the annular feeding path Ru.

In the next binding operation, when the two wires W are fed in the forward direction by the wire feeding portion 3A, the distal end sides of the two wires W cut in the previous binding operation pass through the parallel direction leading portion 55 of the curl guide 50*a*. In the two wires W that are fed by the wire feeding portion 3A and pass through the parallel direction leading portion 55, the one wire W1 comes into contact with the first leading portion 55*b*1 of the parallel direction leading portion 55. On the other hand, the other wire W2 comes into contact with the second leading portion 55*b*2 of the parallel direction leading portion 55.

In the parallel direction leading portion 55, from the introduction portion 55*a* toward the lead-out portion 55*b*, with respect to the first leading portion 55*b*1 in contact with the one wire W1, the second leading portion 55*b*2 in contact with the other wire W2 is inclined in a direction protruding to the inner peripheral side along the radial direction of the annular feeding path Ru.

Accordingly, of the two wires W fed by the wire feeding portion 3A in the forward direction and passing through the parallel direction leading portion 55, with respect to the one wire W1 in contact with the first leading portion 55*b*1, the other wire W2 in contact with the second leading portion 55*b*2 is led toward the inner peripheral side along the radial direction of the annular feeding path Ru.

The two wires W fed in the forward direction by the wire feeding portion 3A and led by the parallel direction leading portion 55 to be arranged in the radial direction of the annular feeding path Ru enter the parallel guide portion 54 from the lead-out portion 55*b* of the parallel direction leading portion 55.

In the parallel guide portion 54, the interval Ra1 between the second guide surface 52*a* of the second wire guide 52 and the third guide surface 53*a* of the third wire guide 53 is set to be greater than the diameter Rb of the wire W and smaller than twice the diameter Rb of the wire W.

As a result, the two wires W, which are fed in the forward direction by the wire feeding portion 3A and enter the parallel guide portion 54 from the lead-out portion 55*b* of the parallel direction leading portion 55, pass through the parallel guide portion 54 while maintaining a state of being arranged in the radial direction of the annular feeding path Ru, as illustrated in FIG. 6B, with the restriction by the interval Ra1 between the second guide surface 52*a* and the third guide surface 53*a* of the parallel guide portion 54.

Figure 7D:
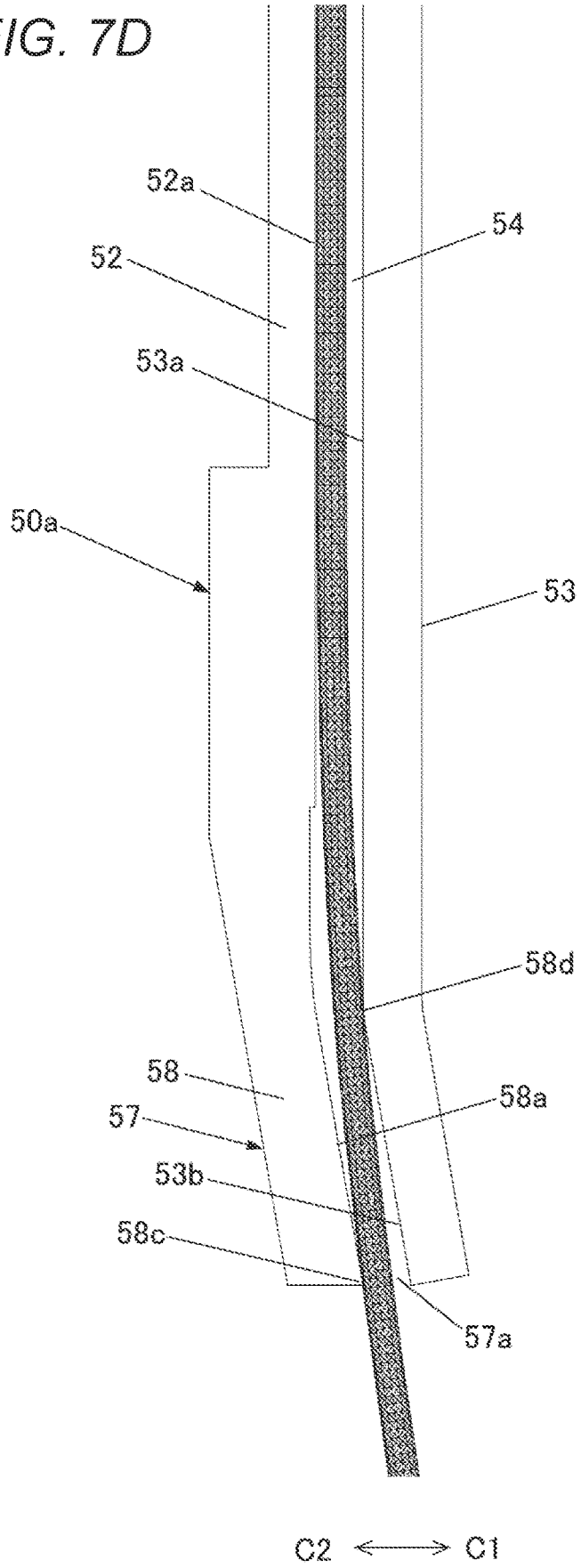
FIG. 7D is a main portion cross-sectional view illustrating an example of an operation of leading the wire in the feeding direction leading portion.

FIG. 7D is a main portion cross-sectional view illustrating an example of an operation of leading the wire in the feeding direction leading portion. The two wires W, which are fed in the forward direction by the wire feeding portion 3A and pass through the feeding direction leading portion 57 from the parallel guide portion 54, are held in the state of being arranged the radial direction of the annular feeding path Ru, as illustrated in FIG. 6C.

The two wires W passing through the feeding direction leading portion 57 from the parallel guide portion 54 are obliquely fed from the outlet portion 57*a* of the feeding direction leading portion 57, which is the outlet portion of the curl guide 50*a*, toward the first direction indicated by the arrow C1. The first direction is a direction in which the feeding direction leading portion 57 is bent along the axial direction of the annular feeding path Ru with respect to the parallel guide portion 54, and is a direction in which the reel 20 is offset. The two wires W passing through the feeding direction leading portion 57 from the parallel guide portion 54 may be curled to be bent in the first direction. For example, as illustrated in FIG. 7D, the two wires W passing through the feeding direction leading portion 57 from the parallel guide portion 54 are fed to the parallel guide portion 54 while being in contact with the second guide surface 52*a* located on an outer side in the first direction in which the feeding direction leading portion 57 is bent and an end surface 58*c* on a fourth guide surface 58*a* side in the outlet portion 57*a*. The two wires W passing through the feeding direction leading portion 57 from the parallel guide portion 54 are also fed to the parallel guide portion 54 while being in contact with a bent portion 58*d* of the third guide surface 53*a* and the fifth guide surface 53*b* located on an inner side in the first direction in which the feeding direction leading portion 57 is bent. Thus, the two wires W passing through the feeding direction leading portion 57 from the parallel guide portion 54 are curled to be bent in the first direction and are obliquely fed in the first direction.

The distal end of the wire W pulled out from the reel 20 by the wire feeding portion 3A and fed in the forward direction is directed in a second direction indicated by the arrow C2, which is an opposite direction to the first direction in which the reel 20 is offset. On the other hand, the wire W passing through the feeding direction leading portion 57 from the parallel guide portion 54 is fed in the first direction, so that an amount of directing the distal end in the second direction is suppressed as compared with the case where the feeding direction leading portion 57 is not provided.

The two wires W, which are curled by the curl guide 50*a*, are arranged in parallel in the radial direction of the annular feeding path Ru, and are further fed from the outlet portion 57*a* of the curl guide 50*a* toward the first direction, are led to the leading guide 50*b* and are further fed in the forward direction by the wire feeding portion 3A, whereby being led by the leading guide 50*b* between the center hook 70C and the second side hook 70L. Then, the two wires W are fed until the distal ends of the two wires W abut against the feeding regulation portion 90. When the distal end of the wire W is fed to a position at which the distal end of the wire W abuts against the feeding regulation portion 90, driving of the feeding motor 31 is stopped.

After the feeding of the wire W in the forward direction is stopped, the motor 80 is driven in the forward rotation direction. In an operation range in which the wire W is locked by the wire locking body 70, the sleeve 71 is regulated from rotating in conjunction with the rotation of the rotation shaft 72 by the rotation regulating portion 74. As a result, as illustrated in FIG. 6C, the rotation of the motor 80 is converted into linear movement, and the sleeve 71 moves in the direction of the arrow A1 which is the forward direction.

When the sleeve 71 is moved in the forward direction, the opening and closing pin 71*a* passes through the opening and closing guide holes 73. As a result, the first side hook 70R is moved in the direction in which the first side hook 70R approaches the center hook 70C by the rotation operation with the shaft 71*b* as a fulcrum. When the first side hook 70R is closed with respect to the center hook 70C, the wire W sandwiched between the first side hook 70R and the center hook 70C is locked in a manner of being capable of moving between the first side hook 70R and the center hook 70C.

The second side hook 70L is moved in the direction in which the second side hook 70L approaches the center hook 70C by the rotation operation with the shaft 71*b* as a fulcrum. When the second side hook 70L is closed with respect to the center hook 70C, the wire W sandwiched between the second side hook 70L and the center hook 70C is locked in a manner that the wire W is not removed from a portion between the second side hook 70L and the center hook 70C.

After the sleeve 71 is advanced to a position where the wire W is locked in the operation of closing the first side hook 70R and the second side hook 70L, the rotation of the motor 80 is temporarily stopped, and the feeding motor 31 is driven in a reverse rotation direction.

Accordingly, the pair of feeding gears 30 (30L and 30R) are reversed, and as illustrated in FIG. 6D, the two wires W sandwiched between the pair of feeding gears 30 (30L and 30R) are fed in the reverse direction indicated by an arrow R. The distal end sides of the two wires W are locked so as not to be removed from a portion between the second side hook 70L and the center hook 70C, and thus the wire W is wound around the reinforcing bars S in the operation of feeding the wire W in the reverse direction.

After winding the wire W around the reinforcing bars S and stopping the driving of the feeding motor 31 in the reverse rotation direction, the sleeve 71 is further moved in the forward direction indicated by the arrow A1 by driving the motor 80 in the forward rotation direction. As illustrated in FIG. 6E, when the movement of the sleeve 71 in the forward direction is transmitted to the cutting portion 6A by the transmission mechanism 62, the movable blade portion 61 rotates, and the wire W locked by the first side hook 70R and the center hook 70C is cut by the operations of the fixed blade portion 60 and the movable blade portion 61.

When the motor 80 is driven in the forward rotation direction, the sleeve 71 is moved in the forward direction indicated by the arrow A1, and the two wires W are cut, the bent portions 71*c*1 and 71*c*2 move in a direction toward the reinforcing bar S substantially simultaneously. Accordingly, the distal end sides of the two wires W locked by the center hook 70C and the first side hook 70R are pressed toward the reinforcing bars S by the bent portion 71*c*1, and are bent toward the reinforcing bars S with the locking position as a fulcrum. When the sleeve 71 is further moved in the forward direction, the wire W locked between the second side hook 70L and the center hook 70C is held in a state of being sandwiched by the bent portion 71*c*1.

The terminal end side of the wire W locked by the center hook 70C and the first side hook 70R and cut by the cutting portion 6A is pressed toward the reinforcing bars S by the bent portion 71*c*2, and is bent toward the reinforcing bars S side with a locking position as a fulcrum. When the sleeve 71 is further moved in the forward direction, the wire W locked between the first side hook 70R and the center hook 70C is held in a state of being sandwiched by the bent portion 71*c*2. In an operation range in which the wire W is bent and formed, the sleeve 71 is regulated from rotating in conjunction with the rotation of the rotation shaft 72 by the rotation regulating portion 74 and is moved in the forward direction without rotating.

After the distal end side and the terminal end side of each of two wires W are bent toward the reinforcing bar S, the motor 80 is further driven in the forward rotation direction, and the sleeve 71 is further moved in the forward direction. When the sleeve 71 moves to a predetermined position, the regulation of the rotation of the sleeve 71 by the rotation regulating portion 74 is released.

Accordingly, when the motor 80 is further driven in the forward rotation direction, the sleeve 71 rotates in conjunction with the rotation shaft 72, and as illustrated in FIG. 6F, the operation of twisting the two wires W locked by the wire locking body 70 is started.

In the binding portion 7A, in an operation range in which the sleeve 71 rotates to twist the wire W, the wire W locked by the wire locking body 70 is twisted, and thus a force that pulls the wire locking body 70 forward along the axial direction of the rotation shaft 72 is applied. On the other hand, the rotation shaft 72 receives a force of being pressed further rearward by the spring 72*c*. Accordingly, the wire locking body 70 moves forward while receiving the force by which the rotation shaft 72 is pressed rearward by the spring 72*c*, and as illustrated in FIG. 6G, the wire locking body 70 twists the wire W while moving forward.

In the binding portion 7A, in the operation range in which the sleeve 71 rotates to twist the wire W, when the wire locking body 70 further rotates in conjunction with the rotation shaft 72, the wire locking body 70 and the rotation shaft 72 further twist the wire W while moving in the forward direction which is the direction in which the gap between the twisted portion of the wire W and the reinforcing bar S decreases.

Therefore, as illustrated in FIG. 6H, a gap between the twisted portion of the wire W and the reinforcing bar S is reduced, and the twisted two wires W are brought into close contact with the reinforcing bar S along the reinforcing bar S.

When it is detected that the load applied to the motor 80 is maximized by twisting the two wires W, the forward rotation of the motor 80 is stopped. Next, when the motor 80 is driven in the reverse rotation direction, the rotation shaft 72 is reversely rotated, and the sleeve 71 is reversely rotated following the reverse rotation of the rotation shaft 72, the sleeve 71 is regulated from rotating in conjunction with the rotation of the rotation shaft 72 by the rotation regulating portion 74. Accordingly, the sleeve 71 is moved in the direction of the arrow A2, which is the reward direction.

When the sleeve 71 moves in the rearward direction, the bent portions 71*c*1 and 71*c*2 are separated from the wire W, and the holding of the wire W by the bent portions 71*c*1 and 71*c*2 is released. When the sleeve 71 is moved in the rearward direction, the opening and closing pin 71*a* passes through the opening and closing guide hole 73. As a result, the first side hook 70R is moved in the direction away from the center hook 70C by the rotation operation with the shaft 71*b* as a fulcrum. The second side hook 70L is moved in the direction away from the center hook 70C by the rotation operation with the shaft 71*b* as a fulcrum. Accordingly, the two wires W binding the reinforcing bars S are removed from the wire locking body 70.

Figure 8B:
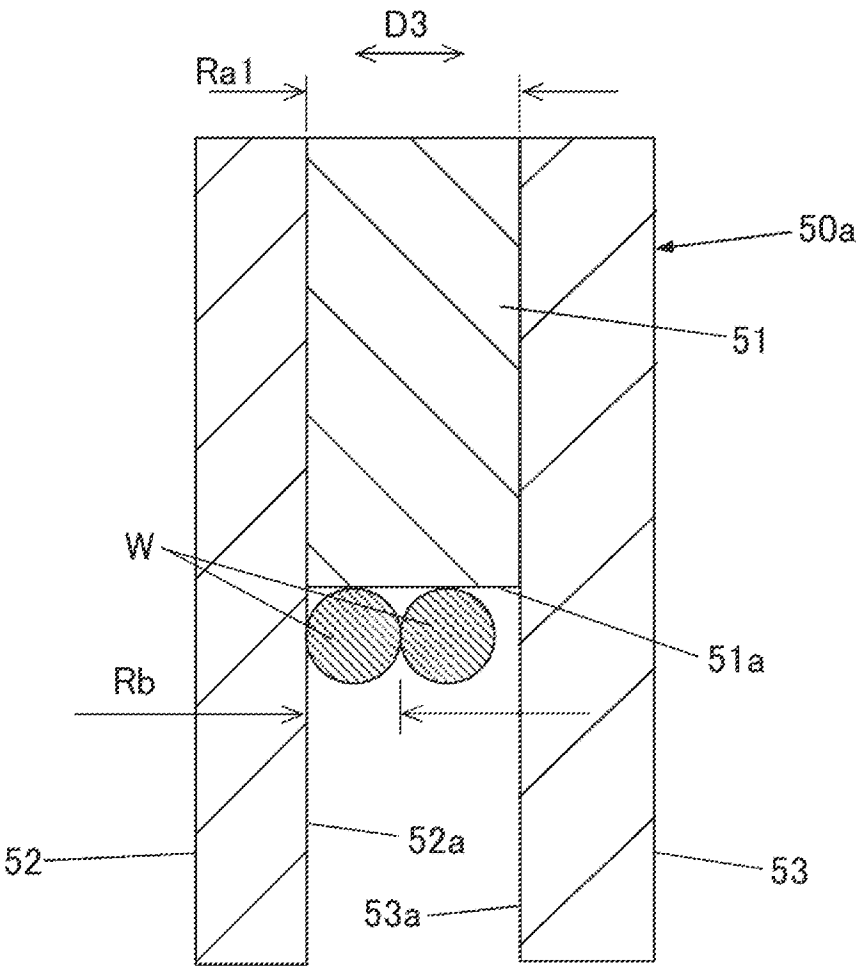
FIG. 8B is a front cross-sectional view of the curl guide illustrating an example of a problem of a reinforcing bar binding machine in the related art.
Figure 8A:
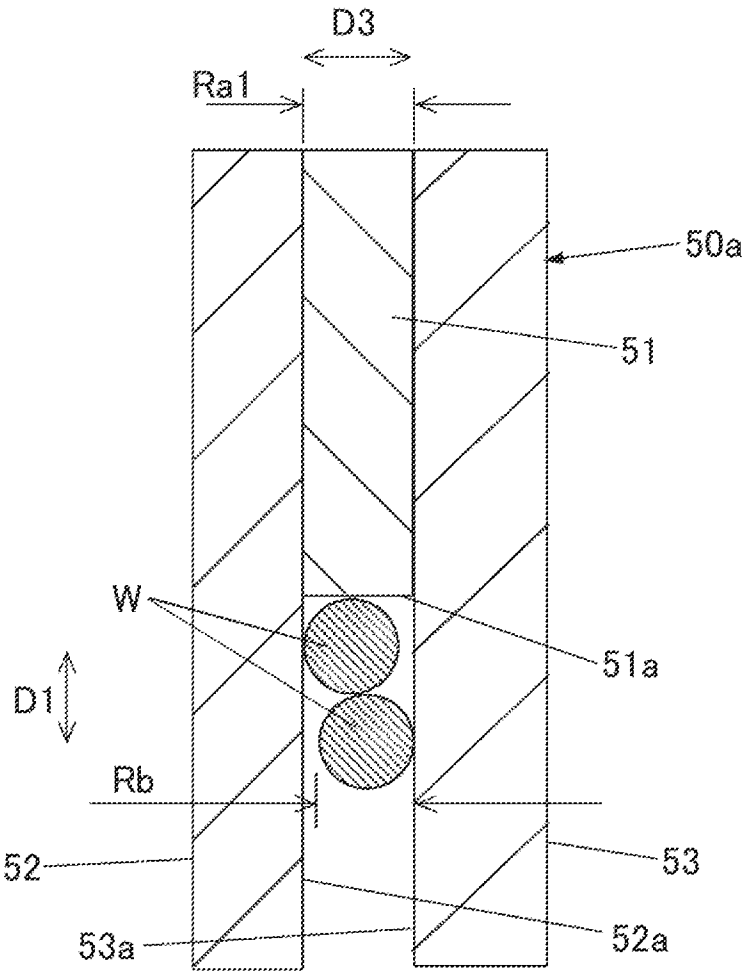
FIG. 8A is a front cross-sectional view of the curl guide illustrating an example of a function and effect of the reinforcing bar binding machine according to the present embodiment.

Function and Effect Example of Reinforcing Bar Binding Machine According to First Embodiment FIG. 8A is a front cross-sectional view of the curl guide illustrating an example of a function and effect of the reinforcing bar binding machine according to the present embodiment, and FIG. 8B is a front cross-sectional view of the curl guide illustrating an example of a problem of a reinforcing bar binding machine in the related art.

In the reinforcing bar binding machine 1A, the reel 20 is disposed to be offset in the first direction indicated by an arrow C1. The wire W which is fed by the wire feeding portion 3A from the reel 20 offset in this first direction and curled by the curl guide 50*a* is directed in a second direction indicated by an arrow C2, which is a direction opposite to the first direction in which the reel 20 is offset.

In the reinforcing bar binding machine having such a configuration, as illustrated in FIG. 8B, in a reinforcing bar binding machine in the related art that binds the reinforcing bars S with two wires W, in the curl guide 50*a*, am interval Ra3 (referred to as an inner width of the curl guide) between the second guide surface 52*a* of the second wire guide 52 and the third guide surface 53*a* of the third wire guide 53 is set to be greater than twice the diameter Rb of the wire W. With such a configuration, the two wires W can be fed in the direction arranged in the axial direction of the annular feeding path Ru indicated by the arrow D3.

However, in the configuration in which the inner width of the curl guide is greater than twice the length of the diameter Rb of the wire W, each wire W is greater than the length corresponding to the diameter Rb of the wire W, and can move in the axial direction (referred to as a left-right direction) of the annular feeding path Ru. When a movable amount of the wire W in the left-right direction is increased in the curl guide 50*a*, an amount of displacement of the position of the distal end of the wire W, which is curled by the curl guide 50*a* by the operation of feeding the wire W in the forward direction, in the left-right direction is increased, and the wire W may not enter the leading guide 50*b*. In addition, the left and right of one wire W and the other wire W may be switched in the curl guide 50*a*, and the two wires W may be twisted in the curl guide 50*a*.

In contrast, in the reinforcing bar binding machine 1A according to the present embodiment, which binds the reinforcing bars S with the two wires W, in the curl guide 50*a*, the interval Ra1 between the second guide surface 52*a* of the second wire guide 52 and the third guide surface 53*a* of the third wire guide 53 is set to be greater than the diameter RB of the wire W and smaller than twice the diameter Rb of the wire W. With such a configuration, the two wires W can be fed in the direction arranged in the radial direction of the annular feeding path Ru indicated by the arrow D1.

As a result, the movable amount of the wire W in the left-right direction is reduced in the curl guide 50*a*, the amount of displacement of the position of the distal end of the wire W, which is curled by the curl guide 50*a* by the operation of feeding the wire W in the forward direction, in the left-right direction is reduced, thereby suppressing the wire W from not entering the leading guide 50*b*. In addition, the left and right of the one wire W and the other wire W are not switched in the curl guide 50*a*, and the two wires W are suppressed from being twisted in the curl guide 50*a*.

As illustrated in FIG. 1D, the two wires W fed in the forward direction by the wire feeding portion 3A is fed from the feeding direction leading portion 57 of the curl guide 50*a* toward the first direction indicated by the arrow C1. Accordingly, a displacement amount WL of the wire W in the second direction indicated by the arrow C2 with respect to the parallel guide portion 54 due to offsetting the reel 20 in the first direction can be made smaller than that in a case where the wire W is not fed out in the first direction. Therefore, the amount of displacement of the position of the distal end of the wire W, which is curled by the curl guide 50*a* by the operation of feeding the wire W in the forward direction, with respect to the parallel guide portion 54 in the second direction is reduced, thereby suppressing the wire W from not entering the leading guide 50*b*.

When the inclination angle of the feeding direction leading portion 57 with respect to the extension direction of the parallel guide portion 54 is less than 3°, an effect of reducing the displacement amount WL is small, the position of the distal end of the wire W, which is curled by the curl guide 50*a*, is displaced in the second direction, and the wire W hardly enters the leading guide 50*b*. On the other hand, when the inclination angle of the feeding direction leading portion 57 with respect to the extension direction of the parallel guide portion 54 is greater than 7°, the position of the distal end of the wire W, which is curled by the curl guide 50*a*, is displaced in the first direction, and the wire W hardly enters the leading guide 50*b*. Therefore, the inclination angle of the feeding direction leading portion 57 with respect to the extension direction of the parallel guide portion 54 is preferably 3° or more and 7° or less.

In the curl guide 50*a*, a portion outside the direction in which the feeding direction leading portion 57 is bent is likely to wear due to contact with the wire W. Therefore, when the fourth wire guide 58 positioned on the outer side in the bending direction of the feeding direction leading portion 57 is detachable from the curl guide 50*a*, the fourth wire guide 58 can be replaced.

Figure 9:
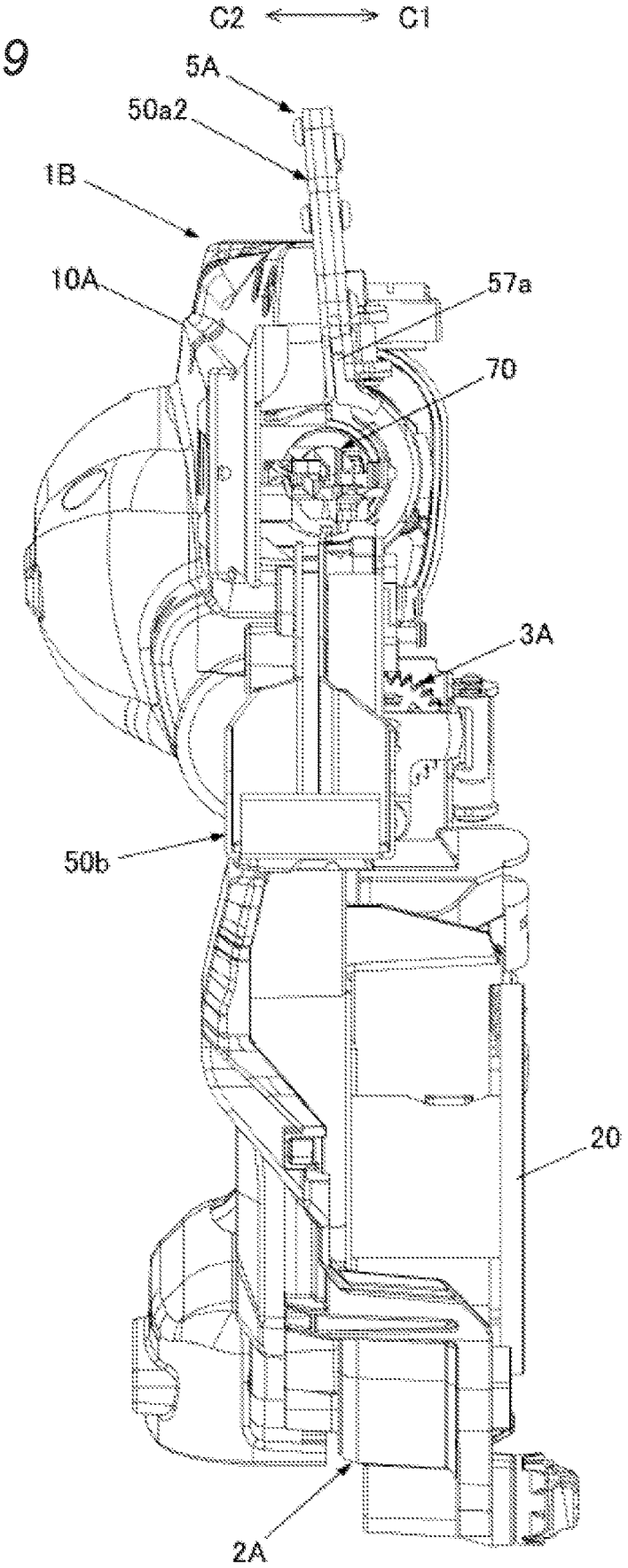
FIG. 9 is a front view illustrating an example of a main portion configuration of a reinforcing bar binding machine according to a second embodiment.

Configuration Example of Reinforcing Bar Binding Machine According to Second Embodiment FIG. 9 is a front view illustrating an example of a main portion configuration of a reinforcing bar binding machine according to a second embodiment. An overall configuration of the reinforcing bar binding machine according to the second embodiment is the same as that of the reinforcing bar binding machine 1A according to the first embodiment.

A reinforcing bar binding machine 1B according to the second embodiment, the outlet portion 57*a* from which the wire W is fed out includes a curl guide 50*a*2 inclined in the direction toward the first direction indicated by the arrow C1.

The curl guide 50*a*2 is an attachment portion to the main body portion 10A and is attached to be inclined in the predetermined direction as a whole.

The curl guide 50*a*2 is attached to the main body portion 10A such that the entire curl guide 50*a*2 is inclined in a direction in which the outlet portion 57*a* is directed to a direction in which the magazine 2A and the reel 20 accommodated in the magazine 2A are offset.

Accordingly, the wire W fed by the wire feeding portion 3A and passing through the curl guide 50*a*2 is fed out from the outlet portion 57*a* in the direction in which the magazine 2A is offset. Therefore, the feeding direction leading portion is formed by the inclination of the curl guide 50*a*2 in the predetermined direction.

Figure 10A:
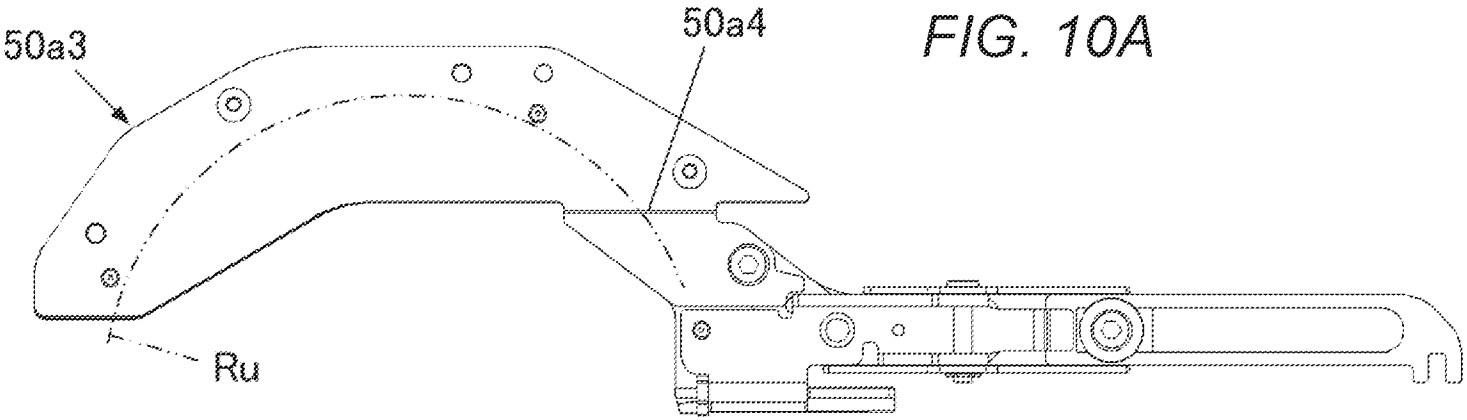
FIG. 10A is a side view illustrating another example of a curl guide.
Figure 10B:
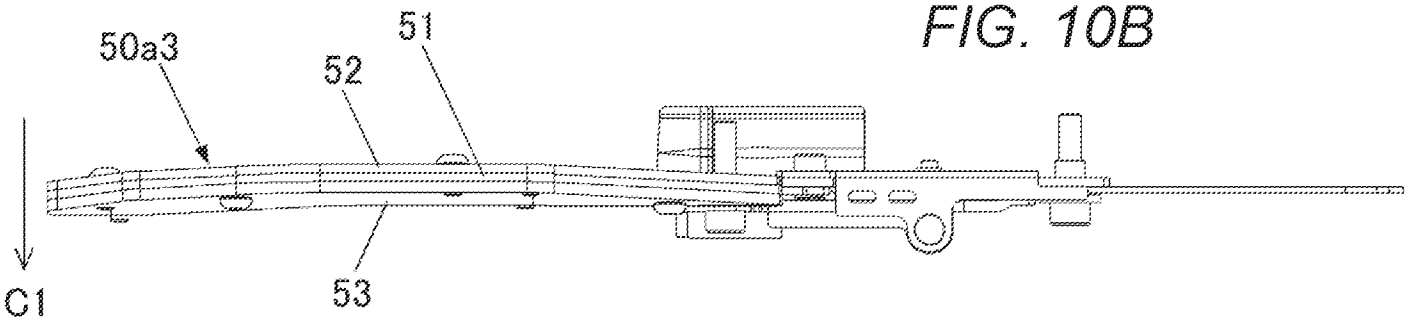
FIG. 10B is a top view illustrating another example of the curl guide.
Figure 10C:
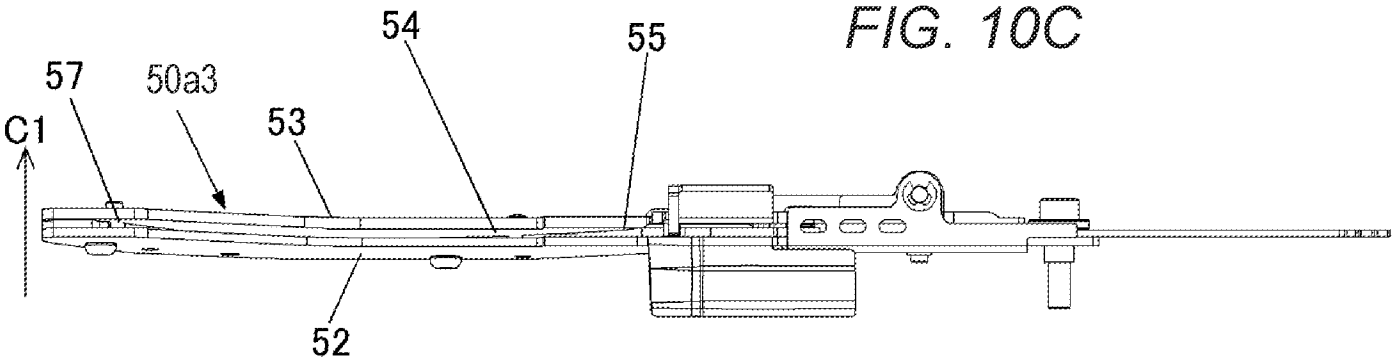
FIG. 10C is a bottom view illustrating another example of the curl guide.
Figure 10D:
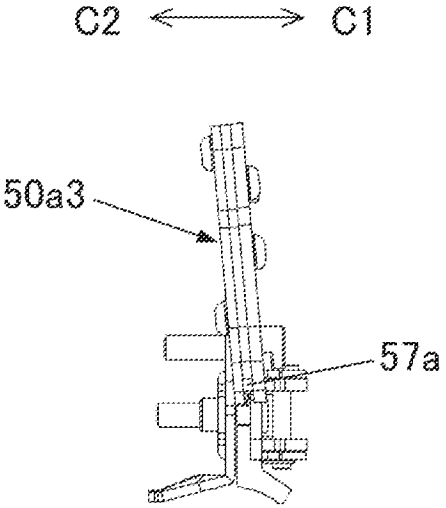
FIG. 10D is a front view illustrating another example of the curl guide.

Configuration Example of Reinforcing Bar Binding Machine According to Third Embodiment FIG. 10A is a side view illustrating another example of a curl guide, FIG. 10B is a top view illustrating another example of the curl guide, FIG. 10C is a bottom view illustrating another example of the curl guide, and FIG. 10D is a front view illustrating another example of the curl guide, which illustrate a main portion configuration of a reinforcing bar binding machine according to a third embodiment.

In the reinforcing bar binding machine according to the third embodiment, a curl guide 50*a*3 includes the feeding direction leading portion 57 in which the outlet portion 57*a* from which the wire W is fed out is inclined in a direction toward a first direction indicated by the arrow C1.

The feeding direction leading portion 57 is formed by inclining a part of the curl guide 50*a*3 in the first direction indicated by the arrow C1. The feeding direction leading portion 57 is inclined in a direction in which the outlet portion 57*a* is directed in a direction in which the magazine 2A and the reel 20 accommodated in the magazine 2A are offset, from a bent portion 50*a*4 on a side close to the main body portion 10A as illustrated in FIG. 1A and the like on a side opposite the outlet portion 57*a*. The direction in which the feeding direction leading portion 57 is bent at the bent portion 50*a*4 is different from the peripheral direction and a direction orthogonal to the peripheral direction of the annular feeding path Ru.

Accordingly, the wire W fed by the wire feeding portion 3A and passing through the curl guide 50*a*3 is fed out from the outlet portion 57*a* in the direction in which the magazine 2A is offset, by the feeding direction leading portion 57. Therefore, the feeding direction leading portion is formed by the inclination of the curl guide 50*a*3 in the predetermined direction.

Figure 11A:
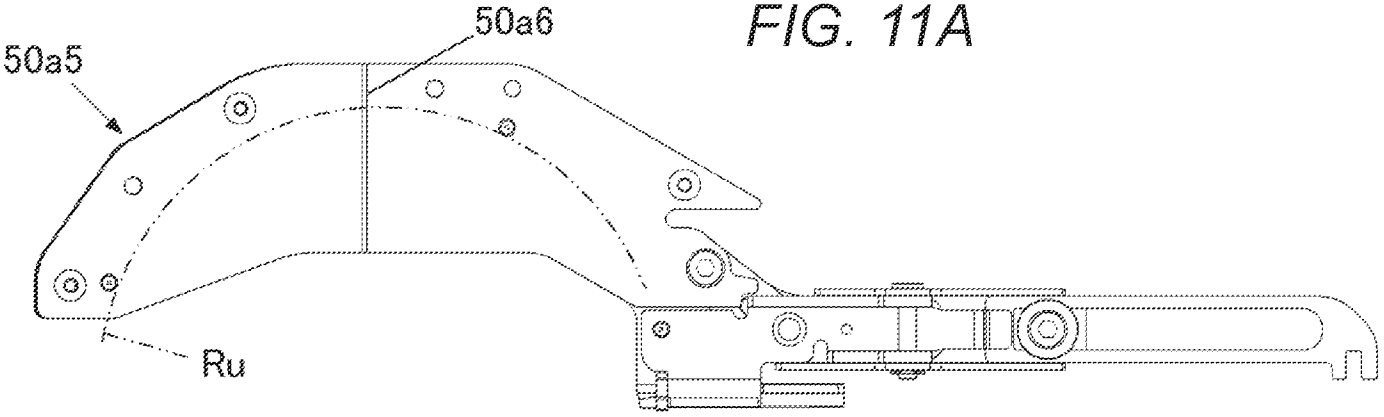
FIG. 11A is a side view illustrating one another example of a curl guide.
Figure 11B:
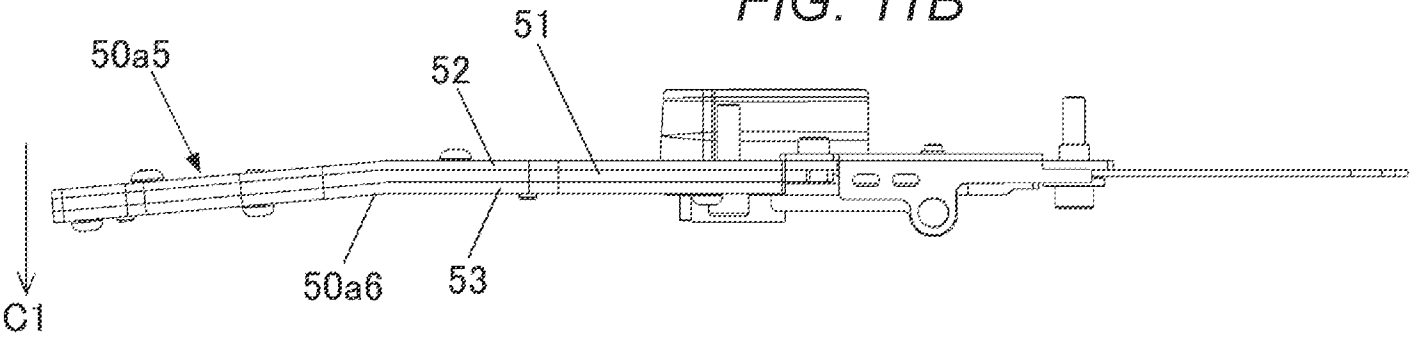
FIG. 11B is a top view illustrating one another example of the curl guide.
Figure 11C:
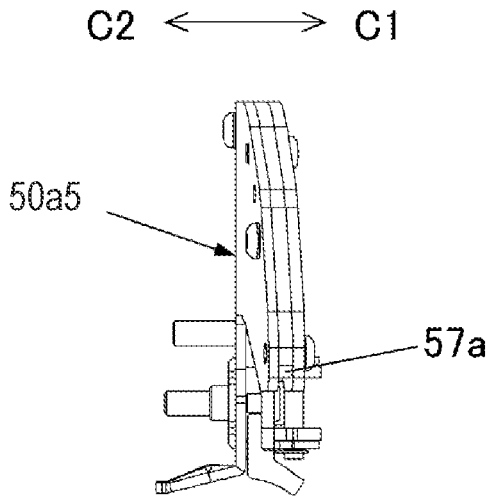
FIG. 11C is a front view illustrating one another example of the curl guide.

Configuration Example of Reinforcing Bar Binding Machine According to Fourth Embodiment FIG. 11A is a side view illustrating one another example of a curl guide, FIG. 11B is a top view illustrating one another example of the curl guide, and FIG. 11C is a front view illustrating one another example of the curl guide, which illustrate a main portion configuration of a reinforcing bar binding machine according to the fourth embodiment.

In the reinforcing bar binding machine according to the fourth embodiment, a curl guide 50*a*5 includes the feeding direction leading portion 57 in which the outlet portion 57*a* from which the wire W is fed out is inclined in a direction toward a first direction indicated by the arrow C1.

The feeding direction leading portion 57 is formed by inclining a part of the curl guide 50*a*5 in the first direction indicated by the arrow C1. The feeding direction leading portion 57 is inclined in a direction in which the outlet portion 57*a* is directed in a direction in which the magazine 2A and the reel 20 accommodated in the magazine 2A are offset, from a bent portion 50*a*6 in a vicinity of an intermediate portion between the outlet portion 57*a* and the main body portion 10A illustrated in FIG. 1A and the like on a side opposite the outlet portion 57*a*. The direction in which the feeding direction leading portion 57 is bent at the bent portion 50*a*6 is a direction orthogonal to the peripheral direction of the annular feeding path Ru.

Accordingly, the wire W fed by the wire feeding portion 3A and passing through the curl guide 50*a*5 is fed out from the outlet portion 57*a* in the direction in which the magazine 2A is offset. Therefore, the feeding direction leading portion is formed by the inclination of the curl guide 50*a*5 in the predetermined direction.

Even with a configuration in which the reinforcing bars S are bound with a single wire W, the offset of the magazine 2A (reel 20) causes a problem in that the wire W is directed in the second direction indicated by the arrow C2. Since the feeding direction leading portion 57 is provided, the displacement amount WL of the wire W directed to the second direction with respect to the parallel guide portion 54 can be made smaller than that in a case where the wire W is not fed out in the first direction. As a result, in the embodiments described above, examples of binding the reinforcing bars S using a plurality of wires W are described, but a configuration in which the reinforcing bars S are bound by a single wire W may be adopted, the number of wires W is not essential.

The present disclosure relates to a binding machine including: an accommodating portion configured to accommodate a wire; a wire feeding portion configured to feed the wire accommodated in the accommodating portion; a curl forming portion configured to constitute an annular feeding path for winding the wire fed by the wire feeding portion around an object to be bound; and a binding portion configured to twist the wire wound around the object to be bound, in which the curl forming portion includes a curl guide configured to curl the wire fed by the wire feeding portion, and a leading guide configured to lead the wire curled by the curl guide to the binding portion, the accommodating portion is disposed to be offset in one direction with respect to the curl guide, and the curl guide is configured to feed out the wire toward the one direction.

Since the accommodating portion is disposed to be offset in the one direction with respect to the curl guide, the wire which is fed from the accommodating portion and is curled by the curl guide is directed in the other direction which is the opposite direction to the one direction in which the accommodating portion is offset.

In the present disclosure, since the wire curled by the curl guide is fed out in the one direction, a displacement amount of the wire directed to the other direction with respect to the curl guide can be reduced as compared with the case where the wire is not fed out in the one direction.

In the present disclosure, since the wire curled by the curl guide is fed in one direction, even when the diameter of the annular feeding path is increased, the plurality of wires can be fed from the curl guide to enter the leading guide. Accordingly, it is not necessary to increase the size of the leading guide, it is possible to suppress an increase in size of the binding machine and an increase in weight of the binding machine, and it is possible to suppress deterioration of operability.

What is claimed is:

1. A binding machine comprising:

a magazine configured to accommodate a reel that includes a tubular hub portion around which a wire is wound, and a pair of flange portions provided at both end sides in an axial direction of the hub portion;

a pair of feeding gears configured to feed the wire accommodated in the magazine;

a curl forming portion configured to constitute an annular feeding path for winding the wire fed by the pair of feeding gears around an object to be bound; and a wire locking body and a sleeve that are configured to twist the wire wound around the object to be bound, wherein the curl forming portion includes:

a curl guide configured to curl the wire fed by the pair of feeding gears, and a leading guide configured to lead the wire curled by the curl guide to the wire locking body and the sleeve, the magazine is disposed to be offset in one direction along an axial direction of the annular feeding path, with respect to the curl guide, the curl guide includes a feeding direction leading portion configured to feed out the wire toward the one direction by being formed by inclining in the one direction, on a part at a distal end side of the curl guide, the feeding direction leading portion includes guide surfaces opposed to each other with a predetermined interval therebetween on both sides along the axial direction of the annular feeding path, and an outlet portion from which the wire is to be fed, and the outlet portion is inclined in a direction toward the one direction.

2. The binding machine according to claim 1, wherein an inclination angle of the feeding direction leading portion is 3° or more and 7° or less.

3. The binding machine according to claim 1, wherein the curl guide is entirely inclined in a direction in which the outlet portion is directed in the one direction.

4. The binding machine according to claim 1, wherein the curl guide is configured to cause a plurality of wires to pass therethrough in a state of being arranged in a radial direction of the annular feeding path.

5. The binding machine according to claim 1, wherein from a front view of the binding machine, the curl guide is located above the leading guide and within a width of the leading guide.

6. The binding machine according to claim 1, wherein from a front view of the binding machine, a center of the leading guide is offset in a direction opposite to the one direction with respect to the curl guide.

* * * * *